US007330180B2

(12) United States Patent
Inada

(10) Patent No.: US 7,330,180 B2
(45) Date of Patent: Feb. 12, 2008

(54) CIRCUIT AND METHOD FOR DRIVING A CAPACITIVE LOAD, AND DISPLAY DEVICE PROVIDED WITH A CIRCUIT FOR DRIVING A CAPACITIVE LOAD

(75) Inventor: Ken Inada, Tokyo (JP)

(73) Assignee: Sharp Kabushiki Kaisha, Osaka (JP)

( * ) Notice: Subject to any disclaimer, the term of this patent is extended or adjusted under 35 U.S.C. 154(b) by 677 days.

(21) Appl. No.: 10/871,066

(22) Filed: Jun. 21, 2004

(65) Prior Publication Data

US 2005/0007324 A1 Jan. 13, 2005

(30) Foreign Application Priority Data

Jul. 8, 2003 (JP) ..... 2003-193775

(51) Int. Cl.
*G09G 5/00* (2006.01)

(52) U.S. Cl. ..... 345/204; 345/87; 345/89; 345/94; 345/211; 345/204; 330/67; 315/219

(58) Field of Classification Search ..... 345/87, 345/89, 95, 98, 100, 204, 211–213, 690
See application file for complete search history.

(56) References Cited

U.S. PATENT DOCUMENTS 4,196,432 A 4/1980 Chihara
4,672,361 A * 6/1987 Kokubo et al. ..... 341/141
5,929,847 A 7/1999 Yanagi et al.
6,310,616 B1 * 10/2001 Yanagi et al. ..... 345/211
6,727,749 B1 * 4/2004 Quinn ..... 330/9
7,209,103 B2 * 4/2007 Maeda et al. ..... 345/87
2002/0097237 A1 7/2002 Tomio et al.

FOREIGN PATENT DOCUMENTS

JP 53-124098 10/1978
JP 07-134573 5/1995
TW 535130 B 11/1990

* cited by examiner

*Primary Examiner*—Richard Hjerpe
*Assistant Examiner*—Jennifer T Nguyen
(74) *Attorney, Agent, or Firm*—Nixon & Vanderhye, PC

(57) ABSTRACT

A video signal line driving circuit includes, for each output terminal TSj, a unit precharge circuit made of a capacitor Cpr and switches SWA1, SWA2, SWB1 and SWB2 for connecting the capacitor Cpr in parallel to a capacitive load of a liquid crystal panel. An OFF period in which first and second output buffers are electrically disconnected from the video signal line is provided between a P period in which a positive voltage is to be applied from the first output buffer in the video signal line driving circuit to the video signal lines (capacitive load) and an N period in which a negative voltage is to be applied from the second output buffer. A first and a second precharge period are set within this OFF period. In the first precharge period, the capacitor Cpr is connected in parallel to the capacitive load of the liquid crystal panel, and in the second precharge period, the capacitor Cpr is connected in parallel to the capacitive load with an orientation that is opposite to the orientation in the first precharge period.

12 Claims, 10 Drawing Sheets

Fig. 4
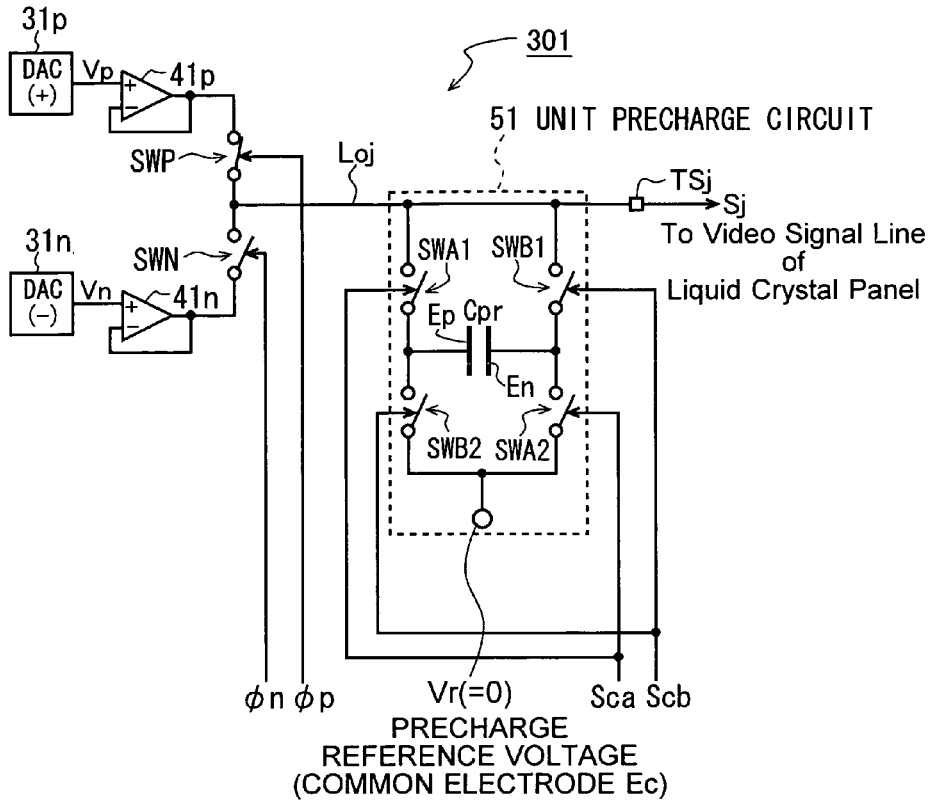
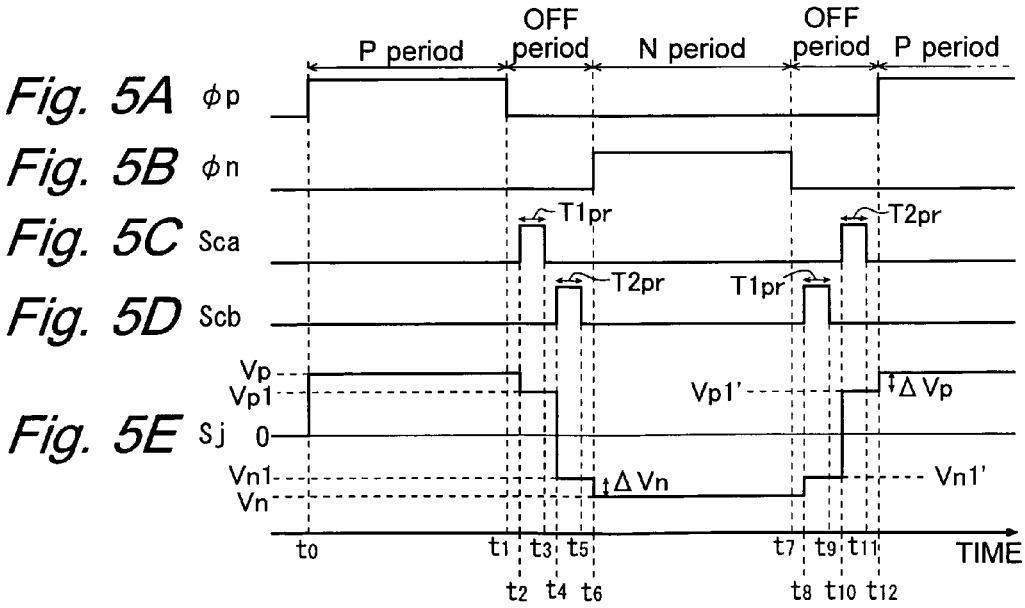

31p
31n
DAC (+)
DAC (−)
Vp
Vn
41p
41n
i1
i2
i3
i4
SW1
SW2
Loj
51
Sj
501
Ls
R
C
Ec
Ep
En
Cpr
Vr (Ec)

Fig. 14A
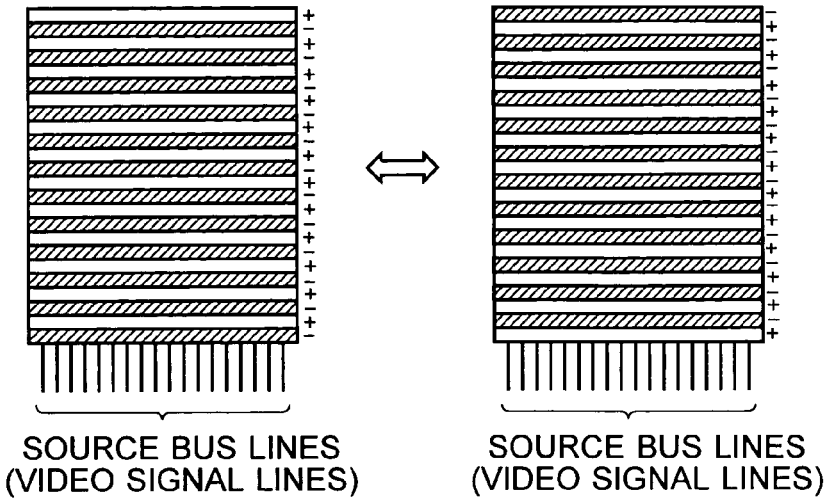
Fig. 14B
Fig. 14C
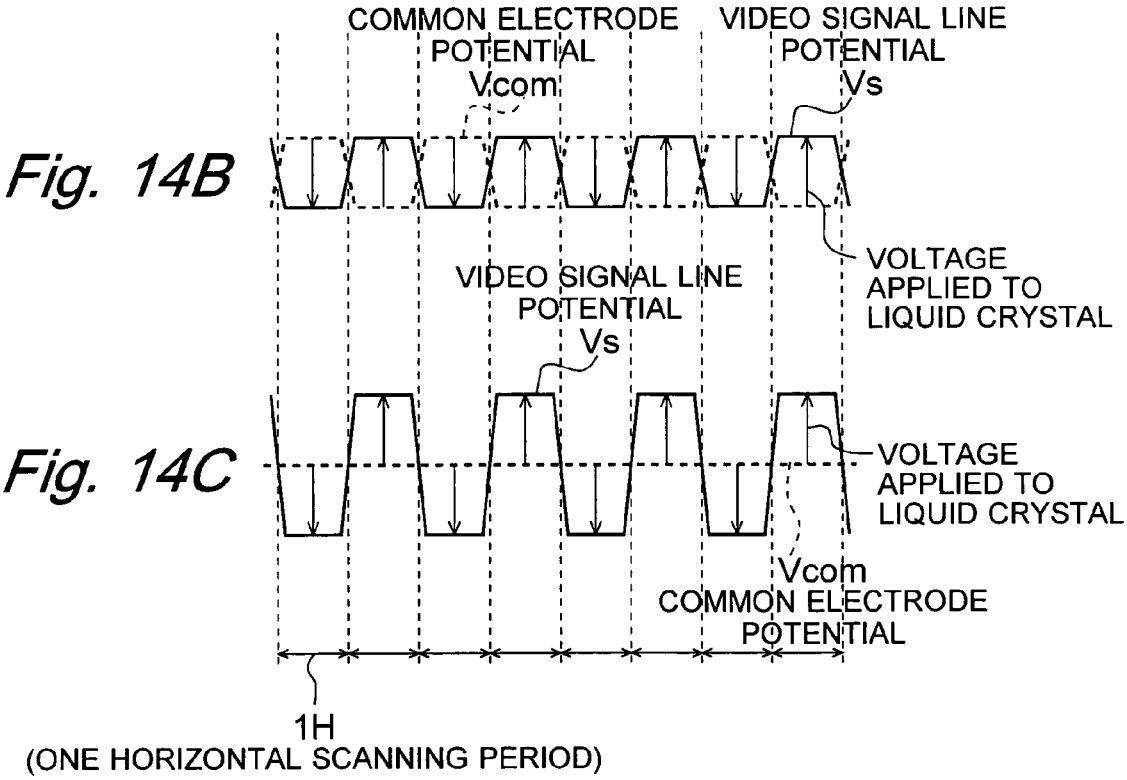

Fig. 15 PRIOR ART
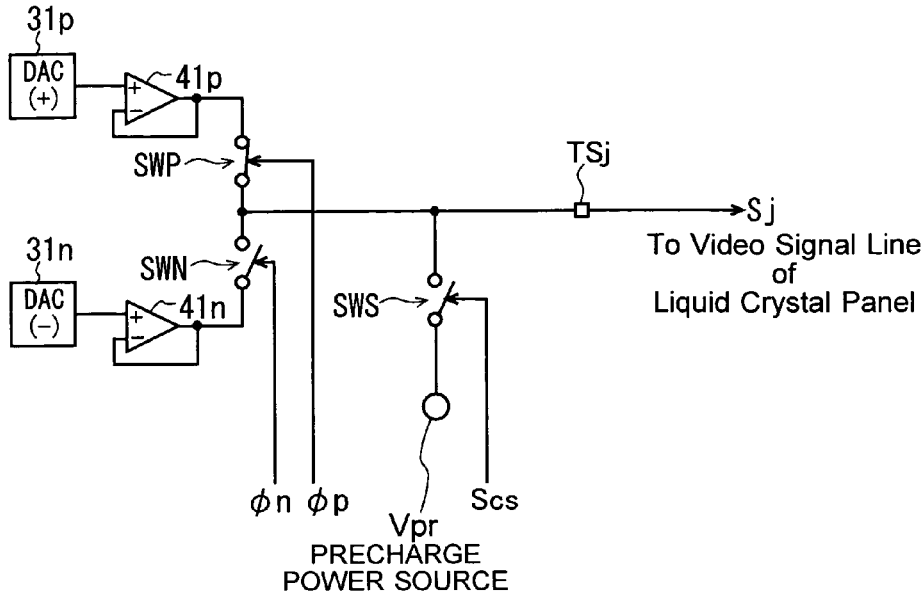
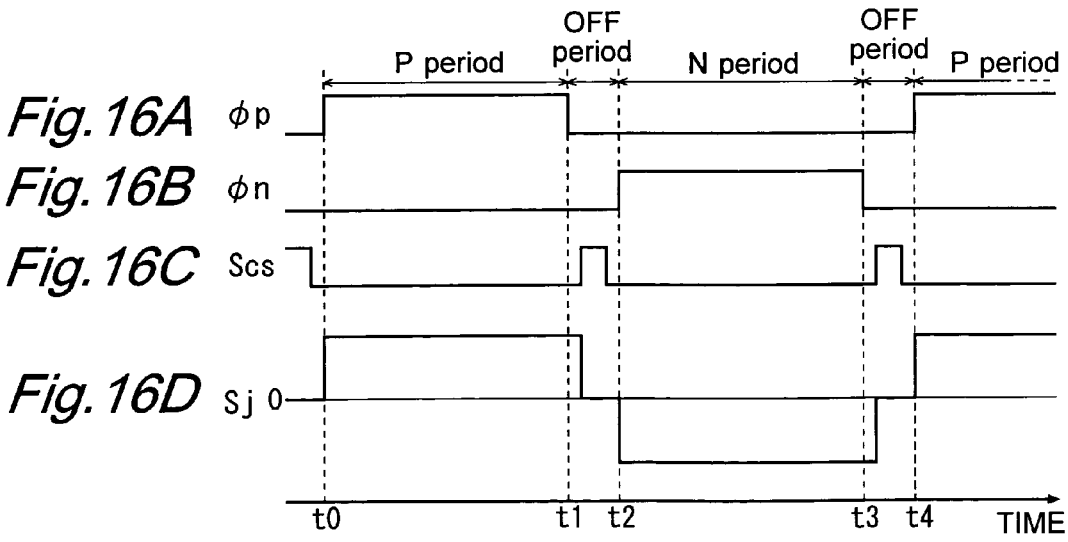

CIRCUIT AND METHOD FOR DRIVING A CAPACITIVE LOAD, AND DISPLAY DEVICE PROVIDED WITH A CIRCUIT FOR DRIVING A CAPACITIVE LOAD

CROSS REFERENCE TO RELATED APPLICATIONS

This application claims priority under 35 U.S.C. §119(a) upon Japanese Patent Application No. 2003-193775 titled "CIRCUIT AND METHOD FOR DRIVING CAPACITIVE LOAD," filed on Jul. 8, 2003, the content of which is incorporated herein by reference.

BACKGROUND OF THE INVENTION

1. Field of the Invention

The present invention relates to driving circuits and driving methods for driving a capacitive load, for example a driving circuit for displaying an image by applying a voltage to a capacitive load, such as an active-matrix liquid crystal panel, as well as to display devices provided with such a driving circuit.

2. Description of the Related Art

Liquid crystal display devices display images by applying a voltage corresponding to an input video signal to each video signal line provided in a liquid crystal panel. That is to say, to display images with the liquid crystal display device, a capacitive load including, for example, the pixel capacitance and the wiring capacitance of the liquid crystal panel is driven by a driving circuit. Such liquid crystal display devices, for example thin film transistor (TFT) based active-matrix liquid crystal panels (in the following also referred to as "TFT-LCD devices"), have the following configuration.

The liquid crystal panel of a TFT-LCD device (referred to as "TFT-LCD panel" below) includes a pair of substrates opposing each other (referred to as "first and second substrate" below). These substrates are fastened at a certain distance (typically several μm) from one another, and a liquid crystal material is filled between the substrates, forming a liquid crystal layer. At least one of these substrates is transparent, and when performing transmissive display, both substrates are transparent. TFT-LCDs are provided with a plurality of scanning signal lines arranged in parallel on the first substrate and a plurality of video signal lines intersecting perpendicularly with the scanning signal lines. In correspondence with each intersection of the scanning lines and the video signal lines, a pixel electrode and a pixel TFT serving as a switching element for electrically connecting the pixel electrode to the video signal line passing through that intersection are provided. The gate terminal of this pixel TFT is connected to the scanning signal line passing through this intersection, the source terminal is connected to the video signal line passing through this intersection, and the drain terminal is connected to the pixel electrode.

A common electrode serving as the opposing electrode for the entire screen is disposed on the second substrate opposing the first substrate. A common electrode driving circuit applies a suitable potential to this common electrode. Consequently, a voltage corresponding to the potential difference between the pixel electrode and the common electrode is applied to the liquid crystal layer. The optical transmittance of the liquid crystal layer is controlled by this applied voltage, so that it is possible to perform the desired pixel display by application of a suitable voltage from the video signal line.

Ordinary liquid crystal display devices, however, are driven by AC driving in order to suppress deterioration of the liquid crystal and sustain the display quality. Examples of AC driving schemes are frame inversion driving, 1H inversion driving, source inversion driving, and dot inversion driving. In frame inversion driving, the polarity of the voltage applied to the liquid crystal is inverted at each frame period of the video signal representing the image to be displayed. In 1H inversion driving, the polarity of the voltage applied to the liquid crystal is inverted at each horizontal scanning period (and at each scanning signal line) of the video signal, and the polarity is also inverted at each frame period. In source inversion driving, the polarity of the voltage applied to the liquid crystal is inverted at each vertical line of the image to be displayed, that is, at each video signal line of the liquid crystal panel, and the polarity is also inverted at each frame period. In dot inversion driving, the polarity of the voltage applied to the liquid crystal is inverted at each scanning signal line and at each video signal line, and the polarity is also inverted at each frame.

For example, in 1H inversion driving, the polarity of the applied voltage signal is inverted between positive and negative at each frame period, and the polarity is also inverted at each horizontal scanning period, as shown in FIG. 14A. Usually, in order to perform such a polarity inversion, the video signal lines are AC driven by the video signal line driving circuit (also referred to as "source driver"), and the common electrode is AC driven by the common electrode driving circuit, as shown in FIG. 14B. If also the common electrode is AC driven in this manner, then the amplitude of the pulse wave voltage outputted from the video signal line driving circuit is relatively small, for example 5 V. On the other hand, if the potential Vcom of the common electrode is fixed (i.e. DC driven), and 1H inversion driving or dot inversion driving or the like is performed, then the amplitude of the pulse wave voltage (video signal line potential Vs) that is outputted from the video signal line driving circuit is for example 10 V, as shown in FIG. 14C, and is about twice greater than when AC driving the common electrode. As a result, the power consumption of the video signal line driving circuit becomes large.

On the other hand, the following two methods are conceivable as methods to decrease the power consumption in the above-described liquid crystal display device: A first method is the method of performing precharging every time the polarity of the voltage applied to the liquid crystal is switched, and employs a circuit configuration as shown for example in FIG. 15 for each output of the video signal line driving circuit (see for example JP H07-134573A, and the corresponding U.S. Pat. No. 5,929,847 (the content of this U.S. patent is incorporated herein by reference)). With this circuit configuration, a video signal line driving circuit outputting a driving signal Sj to be applied to the video signal lines is provided, for each output terminal TSj, with a positive side switch SWP and a negative side switch SWN, which are substantially reciprocally turned on and off in order to invert the polarity of the voltage applied to the video signal line. The positive side switch SWP is controlled by a positive voltage application control signal ϕp as shown in FIG. 16A. When the positive voltage application control signal ϕp is at high level (H level), then the positive side switch SWP is turned on, and when the positive voltage application control signal ϕp is at low level (L level), then the positive side switch SWP is turned off. The negative side switch SWN is controlled by a negative voltage application control signal ϕn as shown in FIG. 16B. When the negative voltage application control signal φn is at H level, then the positive side switch SWN is turned on, and when the negative voltage application control signal φn is at L level, then the positive side switch SWN is turned off. Thus, the positive side and negative side switches SWP and SWN switch alternately between a period in which a positive voltage is applied to the video signal line so that a positive voltage is held by the pixel capacitance formed by the pixel electrode and the common electrode (referred to as "P period" below), and a period in which a negative voltage is applied to the video signal line so that a negative voltage is held by the pixel capacitance (referred to as "N period" below), as shown in FIG. 16D. In addition, between the P period and the N period, there is a period during which both the positive side switch SWP and the negative side switch SWN are turned off (both φp and φn are at L level), and the output buffers 41*p* and 41*n* of the video signal line driving circuit are electrically disconnected from the video signal line (this period is referred to as "OFF period" below), as shown in FIGS. 16A and 16B.

In this first method, in addition to the positive side switch SWP and the negative side switch SWN, a power source referred to as "precharge power source" and a switch SWS are provided. One end of the switch SWS is connected to a suitable position on the signal line connecting the point where the positive side switch SWP is connected to the negative side switch SWN to the video signal line of the liquid crystal panel, and the other end of the switch SWS is connected to the precharge power source. This switch SWS, which is turned on when the precharge control signal Scs shown in FIG. 16C is at H level, and is turned off when the precharge control signal Scs is at L level, operates in synchronization with the positive side switch SWP and the negative side switch SWN. That is to say, based on a precharge control signal Scs, this switch SWS is turned on within the OFF period that is inserted between the P period and the N period, so that the video signal line is precharged with the precharge power source. If the voltage Vpr of the precharge power source is zero, which is precisely the mean voltage value between the positive voltage and the negative voltage outputted from the video signal line driving circuit, that is, if the other side of the switch SWS is connected to the common electrode of the liquid crystal panel, then the voltage with which the output buffers 41*p* and 41*n* of the video signal line driving circuit are to drive the video signal line becomes about half of the voltage in the case that this method is not employed, and the power consumption is reduced accordingly. That is to say, By turning the switch SWS on during the OFF period, for example the period of transition from the P period to the N period, the potential of the video signal line is precharged to an intermediate potential, and after that, a negative voltage is applied from a video signal line driving circuit. Thus, the voltage with which the output buffer 41*n* of the video signal line driving circuit is to drive the video signal line becomes half the potential change amount when switching polarities as shown in FIG. 16D.

In the second method for reducing the power consumption in liquid crystal display devices, by forming a closed loop including the static capacitance of the liquid crystal (capacitance corresponding to the above-noted pixel capacitance) in the period corresponding to the above-described OFF period, the charge that has accumulated in this liquid crystal static capacitance is discharged, and thus a reduction of the power consumption is attained (see for example JP S53-124098A and the corresponding U.S. Pat. No. 4,196,432). FIGS. 17A and 17B show a simplified equivalent circuit illustrating this second method. In this second method, the liquid crystal static capacitance (LCD) Co is charged as shown in FIG. 17A in the period corresponding to the P period in the first method for example, whereas in the period corresponding to the OFF period in the first method, a closed loop including the liquid crystal static capacitance Co is formed as shown in FIG. 17B, and the charge that has accumulated in the liquid crystal static capacitance Co is discharged. Thus, the liquid crystal driving current is trimmed, and the power consumption of the liquid crystal display device is reduced.

As explained above, with these first and second conventional methods, a reduction of the power consumption can be attained by reducing the changes of the video signal line potential to be changed by the driving circuit. However, the effect of these methods is confined to a reduction of the power consumption based on making the change of the video signal line potential to be changed by the driving circuit half the potential change of the video signal line during the time when the polarity is inverted, and a further reduction of the power consumption could not be attained.

SUMMARY OF THE INVENTION

It is thus an object of the present invention to provide a driving circuit and a driving method for driving a capacitive load by applying to the capacitive load a voltage whose polarity is periodically inverted, as in a liquid crystal display device, wherein the driving circuit and the driving method can decrease the power consumption more than in conventional methods.

In accordance with a first aspect of the present invention, a driving circuit for driving a capacitive load by applying to the capacitive load a voltage that corresponds to an input signal and whose polarity is periodically inverted comprises:

an output circuit for outputting the voltage corresponding to the input signal and applying the voltage corresponding to the input signal to the capacitive load;

an open/close circuit for electrically disconnecting the output circuit from the capacitive load for a predetermined time interval in which the polarity of the voltage applied to the capacitive load is inverted;

a capacitor having a predetermined capacitance; and a connection switching circuit for connecting the capacitor for a first predetermined period within an OFF period, which is the predetermined time interval during which the output circuit is electrically disconnected from the capacitive load, in parallel to the capacitive load, and connecting the capacitor for a second predetermined period after the first predetermined period within the OFF period in parallel to the capacitive load with an orientation that is opposite to the orientation in the first predetermined period.

With this configuration, after the capacitive load has been charged by the output circuit, the capacitor becomes charged with the same potential and the same polarity as the capacitive load by connecting the capacitor in parallel to the capacitive load in a first predetermined period within the OFF period during which the output circuit is electrically disconnected from the capacitive load, and the capacitive load becomes charged to the same potential as the capacitor but at opposite polarity as in the first predetermined period by connecting the capacitor in parallel to the capacitive load but with opposite orientation in a second predetermined period within the OFF period. Thus, in the second predetermined period of the OFF period, the capacitive load is precharged by the accumulated charge of the capacitor, so that the potential change of the capacitive load to be changed by the output circuit after the OFF period has passed is decreased in accordance with the charge voltage of the capacitor, and becomes less than half the potential change of when inverting the polarity. As a result, better results than in the conventional art can be attained with regard to reducing the power consumption of the driving circuit.

It is preferable that the connection switching circuit connects the capacitor in parallel to the capacitive load with the same orientation for the first predetermined period in a second OFF period following a first OFF period as an orientation of the second predetermined period in the first OFF period, the first and second OFF periods each being the predetermined time interval during which the output circuit is electrically disconnected from the capacitive load.

With this configuration, the capacitor is connected in parallel to the capacitive load with the same orientation in the first predetermined period within a second OFF period as an orientation of the second predetermined period in the first OFF period, so that the capacitor, which is charged in the second predetermined period within the first OFF period, is further charged with the same polarity in the first predetermined period within the second OFF period. Thus, the accumulated charge in the capacitor rises as the polarity inversion of the voltage applied to the capacitive charge is repeated, so that the potential change of the capacitive load that is to be changed by the output circuit becomes gradually smaller. As a result, the power consumption of the driving circuit can be reduced considerably.

In this driving circuit for driving a capacitive load, it is preferable that the connection switching circuit comprises:

a first and a second switch that are turned on during one of the first and second predetermined periods and are turned off during the other of the first and second predetermined periods;

a third and a fourth switch that are turned off during the one of the first and second predetermined periods and are turned on during the other of the first and second predetermined periods;

wherein one side of the capacitor is connected via the first switch to one side of the capacitive load and is connected via the fourth switch to a predetermined precharge reference voltage; and wherein the other side of the capacitor is connected via the third switch to the one side of the capacitive load and is connected via the second switch to the predetermined precharge reference voltage.

With this configuration, in one of the first and second predetermined periods, the first switch inserted between one side of the capacitor and one side of the capacitive load is turned on and the second switch inserted between the other side of the capacitor and the predetermined precharge reference voltage is turned on, whereas in the other of the first and second predetermined periods, the fourth switch inserted between the one side of the capacitor and the predetermined precharge reference voltage is turned on and the third switch inserted between the other side of the capacitor and the one side of the capacitive load is turned on. Consequently, in the first predetermined period within the OFF period during which the output circuit is electrically disconnected from the capacitive load, the capacitor is connected in parallel to the capacitive load, and in the second predetermined period following thereafter, the capacitor is connected in parallel to the capacitive load but with opposite orientation. Thus, the potential change of the capacitive load that is to be changed by the output circuit becomes smaller, in accordance with the charge voltage of the capacitor, and as a result, the power consumption of the driving circuit can be reduced more than in the conventional art.

In accordance with a second aspect of the present invention, a display device for displaying an image represented by an input signal by applying to a capacitive load a voltage that corresponds to the input signal and whose polarity is periodically inverted, comprises:

an output circuit for outputting the voltage corresponding to the input signal and applying the voltage corresponding to the input signal to the capacitive load;

an open/close circuit for electrically disconnecting the output circuit from the capacitive load for a predetermined time interval in which the polarity of the voltage applied to the capacitive load is inverted;

a capacitor having a predetermined capacitance; and a connection switching circuit for connecting the capacitor for a first predetermined period within an OFF period, which is the predetermined time interval during which the output circuit is electrically disconnected from the capacitive load, in parallel to the capacitive load, and connecting the capacitor for a second predetermined period after the first predetermined period within the OFF period in parallel to the capacitive load with an orientation that is opposite to the orientation in the first predetermined period.

With this configuration, as in the first aspect of the present invention, the capacitive load is precharged by the charge charged to the capacitor in the OFF period before the output circuit applies a voltage to the capacitive load, so that the potential change of the capacitive load to be changed by the output circuit after the OFF period has passed is decreased in accordance with the charge voltage of the capacitor. As a result, the power consumption of the driving circuit can be decreased more than in the conventional art.

The display device may further comprise:

a plurality of video signal lines;

a plurality of scanning signal lines intersecting with the plurality of video signal lines;

a scanning signal line driving circuit for generating a plurality of scanning signals for selectively driving the plurality of scanning signal lines and applying the plurality of scanning signals respectively to the plurality of scanning signal lines; and a plurality of pixel formation portions arranged in a matrix in correspondence with intersections of the video signal lines and the scanning signal lines;

wherein each pixel formation portion comprises:

a switching element that is turned on and off by the scanning signal applied by the scanning signal line driving circuit to the scanning signal line passing through the corresponding intersection;

a pixel electrode that is connected via the switching element to the video signal line passing through the corresponding intersection; and a common electrode that is shared by the plurality of pixel formation portions and that is arranged such that a predetermined capacitance is formed between the common electrode and the pixel electrode;

wherein the capacitive load is formed by the video signal lines, the pixel electrodes and the common electrode; and wherein the output circuit applies a voltage corresponding to the input signal to each of the video signal lines; and wherein the capacitor and the connection switching circuit are provided for each of the video signal lines.

With this configuration, a capacitor and a connection switching circuit are provided for the capacitive load formed by the video signal lines as well as the pixel electrode and the common electrode, and the capacitive load is precharged by the capacitor and the connection switching circuit in the OFF period, so that, of the potential changes of the video signal lines at the time the polarity of the voltage applied to the capacitive load is inverted, the potential change to be changed by the output circuit becomes smaller in accordance with the charge voltage of the capacitor. Thus, the power consumption of the driving circuit of the video signal lines in a liquid crystal display device or the like can be reduced more than in the conventional art.

In accordance with a third aspect of the present invention, a driving method for driving a capacitive load by applying with an output circuit to the capacitive load a voltage that corresponds to an input signal and whose polarity is periodically inverted comprises:

a voltage application step of applying to the capacitive load a voltage corresponding to the input signal;

a disconnection step of electrically disconnecting the output circuit from the capacitive load for a predetermined time interval in which the polarity of the voltage applied to the capacitive load is inverted;

a first connection step of connecting a capacitor having a predetermined capacitance for a first predetermined period within an OFF period, which is the predetermined time interval during which the output circuit is electrically disconnected from the capacitive load, in parallel to the capacitive load; and a second connection step of connecting the capacitor for a second predetermined period after the first predetermined period within the OFF period in parallel to the capacitive load with an orientation that is opposite to the orientation in the first predetermined period.

These and other objects, features, aspects and advantages of the present invention will become more apparent from the following detailed description of the present invention when taken in conjunction with the drawings.

BRIEF DESCRIPTION OF THE DRAWINGS

FIG. 4 is a circuit diagram showing a portion (corresponding to one video signal line) of the DA conversion circuit, the output circuit and the precharge circuit of the video signal line driving circuit in this embodiment.

FIGS. 5A to 5E are signal waveform diagrams illustrating the operation of the video signal line driving circuit in this embodiment.

FIG. 14A is a schematic diagram illustrating the 1H inversion driving method in a liquid crystal display device.

FIGS. 14B and 14C are voltage waveform diagrams illustrating the 1H inversion driving method in a liquid crystal display device.

FIG. 15 is a circuit diagram illustrating a first conventional method for reducing the power consumption in a liquid crystal display device.

FIGS. 16A to 16D are signal waveform diagrams illustrating the first conventional method.

DESCRIPTION OF THE PREFERRED EMBODIMENTS

The following is a description of embodiments of the present invention, with reference to the accompanying drawings.

1.1 Overall Configuration and Operation

Figure 1A:
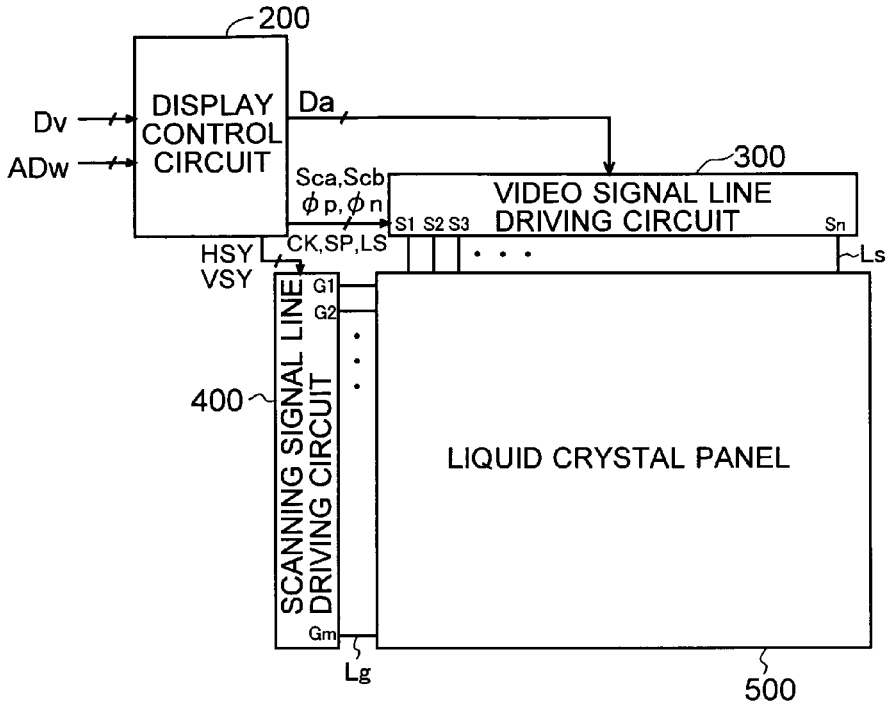
FIG. 1A is a block diagram showing the configuration of a liquid crystal display device in accordance with an embodiment of the present invention.

FIG. 1A is a block diagram showing the configuration of a liquid crystal display device according to an embodiment of the present invention. This liquid crystal display device includes a display control circuit 200, a video signal line driving circuit 300, a scanning signal line driving circuit 400, and an active matrix-type liquid crystal panel 500.

Figure 2:
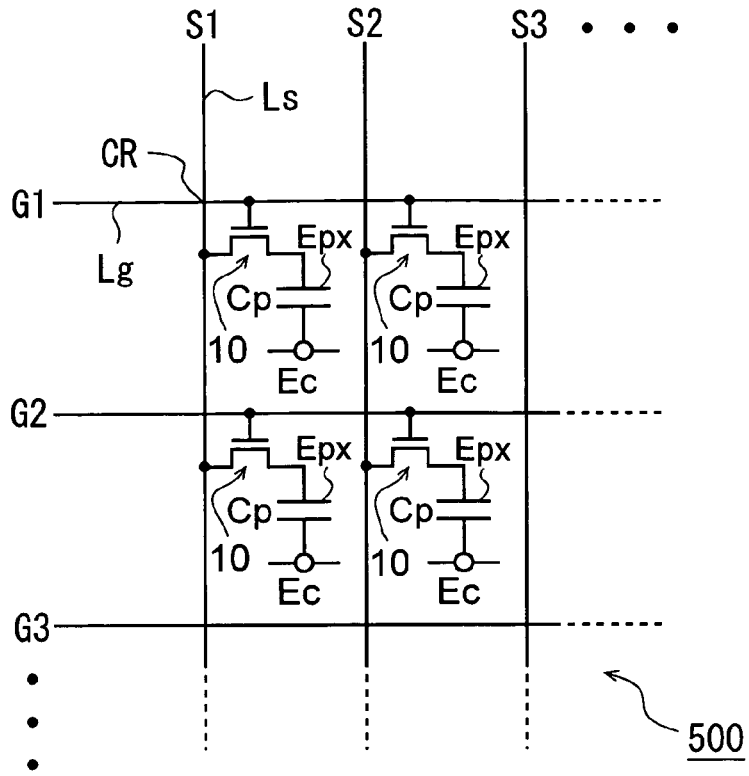
FIG. 2 is a circuit diagram showing the configuration of a pixel formation portion (four pixels) of a liquid crystal panel in this embodiment.

The liquid crystal panel 500, which serves as the display portion in this liquid crystal display device, comprises a plurality of scanning signal lines Lg, which respectively correspond to the horizontal scanning lines in an image represented by image data Dv received from an external CPU or the like, a plurality of video signal lines Ls intersecting with the plurality of scanning signal lines Lg, and a plurality of pixel formation portions that are provided in correspondence to the intersections of the plurality of scanning signal lines Lg and the plurality of video signal lines Ls. These pixel formation portions are arranged in a matrix, and each of the pixel formation portions has in principle the same configuration as the pixel formation portions in conventional active matrix-type liquid crystal panels. That is to say, each of the pixel formation portions is made of a TFT 10 serving as a switching element, a pixel electrode Epx, a common electrode Ec, and a liquid crystal layer, as shown in FIG. 2. The source terminal of the TFT 10 is connected to the video signal line Ls passing through the corresponding intersection CR, and the gate terminal of the TFT 10 is connected to the scanning signal line Lg passing through the corresponding intersection CR. The pixel electrode Epx is connected to the drain electrode of the TFT 10. The common electrode Ec serves as the opposing electrode, which is shared by the plurality of pixel formation portions. The liquid crystal layer is shared by the plurality of pixel formation portions and is sandwiched between the pixel electrode Epx and the common electrode Ec. The pixel electrode Epx, the common electrode Ec and the liquid crystal layer sandwiched between them form a pixel capacitance Cp.

In this embodiment, image data (in a narrow sense) representing an image to be displayed on the liquid crystal panel 500 and data determining the timing of the display operation (for example data indicating the frequency of the display clock) (referred to as "display control data" in the following) are sent from the CPU of an external computer or the like to the display control circuit 200 (in the following, the data Dv sent from the outside are referred to as "image data in a broad sense"). That is to say, the external CPU or the like supplies the image data (in the narrow sense) and the display control data, which together constitute the image data Dv in the broad sense, as well as address signals ADw to the display control circuit 200, and the image data in the narrow sense and the display control data are respectively written into a display memory and a register (described later) in the display control circuit 200.

Based on the display control data written into the register, the display control circuit 200 generates a display clock signal CK, a horizontal synchronization signal HSY, a vertical synchronization signal VSY, a start pulse signal SP, and a latch strobe signal LS. Moreover, the display control circuit 200 reads out the image data that have been written into the display memory by the external CPU or the like, and outputs it as a digital image signals Da. The display control circuit 200 also generates a positive voltage application control signal ϕp and a negative voltage application control signal ϕn, which are control signals for periodically inverting the polarity of the voltage applied to the liquid crystal in the liquid crystal panel 500, as well as a first precharge polarity control signal Sca and a second precharge polarity control signal Scb, which are control signals for controlling the precharge polarity, as described later. Thus, of the signals generated by the display control circuit 200, the clock signal CK, the start pulse signal SP, the latch strobe signal LS, the digital image signal Da, the positive and negative voltage application control signals ϕp and ϕn, and the first and second precharge polarity control signals Sca and Scb are supplied to the video signal line driving circuit 300, and the horizontal synchronization signal HSY and the vertical synchronization signal VSY are supplied to the scanning signal line driving circuit 400. It should be noted that the following explanations are for an image display with 64 gray levels, but the number of gray levels is not limited to this. If the number of gray levels is 64 as in the present embodiment, then the digital image signal Da is a 6-bit signal.

As noted above, the data representing the image to be displayed on the liquid crystal panel 500 are supplied pixel for pixel as the digital image signal Da to the video signal line driving circuit 300, together with the clock signal CK as the signal indicating the timing, the start pulse signal SP, the latch strobe signal LS, the positive and negative voltage application control signal ϕp and ϕn, and the first and second precharge polarity control signals Sca and Scb. Based on these signals CK, SP, LS, ϕp, ϕn, Sca and Scb, the video signal line driving circuit 300 generates video signals S1 to Sn for driving the liquid crystal panel 500 (referred to as "driving video signals" in the following), and applies these driving video signals S1 to Sn to the plurality of (n) video signal lines Ls of the liquid crystal panel 500, respectively.

Based on the horizontal synchronization signal HSY and the vertical synchronization signal VSY, the scanning signal line driving circuit 400 generates scanning signals G1 to Gm to be respectively applied to the plurality of (m) scanning signal line Lg in order to select the scanning signal lines Lg of the liquid crystal panel 500 one after the other for one horizontal scanning period each. The application to the scanning signal lines Lg of the active scanning signal for selecting all of the scanning signal lines one by one is carried out in repetition with one vertical scanning period as the period.

In the liquid crystal panel 500, the video signal line driving circuit 300 applies the driving video signals S1 to Sn based on the digital image signals Da in the above-describe manner to the n video signal lines Ls, and the scanning signal line driving circuit 400 applies the scanning signals G1 to Gm to the m scanning signal lines Lg. Thus, the TFTs 10 connected to each of the scanning signal lines Lg are turned on when the scanning signal Gi (with i=1 . . . m) applied to that scanning signal line Lg is active, and are turned off when that scanning signal Gi is inactive. Moreover, a driving video signal Sj (j=1 . . . n) applied to the video signal line Ls connected to the source terminal of each the TFTs 10 is applied as the voltage signal to the pixel electrode Epx connected to the drain electrode of that TFT that is on. After that, when that TFT is turned off, a voltage corresponding to the potential difference between the pixel electrode Epx and the common electrode Ec is held by the pixel capacitance Cp formed by the pixel electrode Epx and the common electrode Ec. Thus, a voltage corresponding to the difference between the potential of the pixel electrode Epx given by the driving video signals S1 to Sn and the potential of the common electrode Ec given by the predetermined power source circuit is applied to the liquid crystal layer of the liquid crystal panel 500, and the transparency of the liquid crystal layer is controlled by this applied voltage. Thus, the liquid crystal panel 500 displays the image represented by the image data Dv obtained from the external CPU. It should be noted that in the present embodiment, a fixed potential is applied to the common electrode Ec (in the following, this fixed potential is assumed to be the ground level (0)), but the present invention is not limited to this (see modified examples below).

2 Display Control Circuit

Figure 1B:
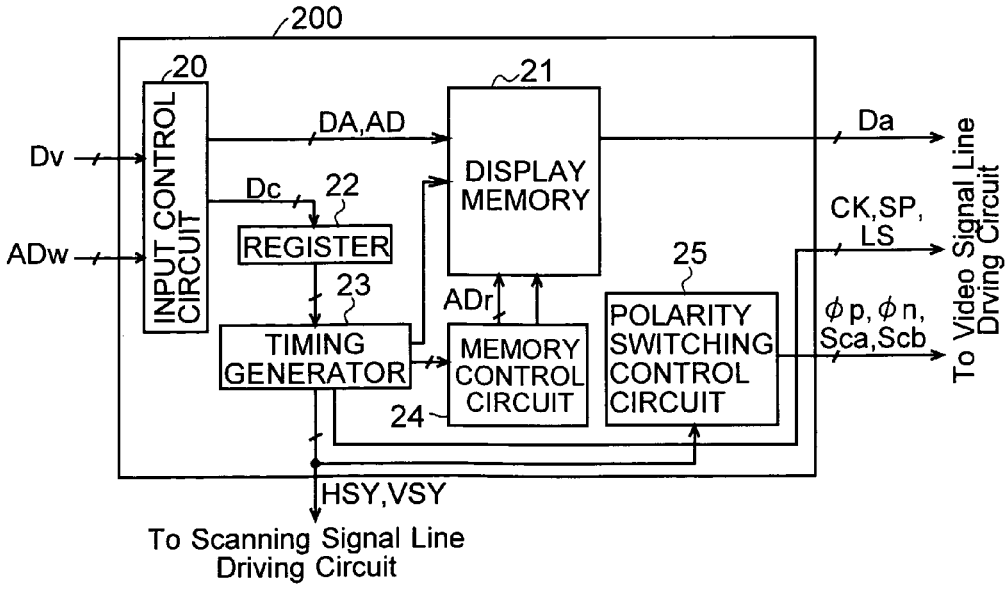
FIG. 1B is a block diagram showing the configuration of a display control circuit in this embodiment.

FIG. 1B is a block diagram showing the configuration of the display control circuit 200 in the above-described liquid crystal display device. This display control circuit 200 includes an input control circuit 20, a display memory 21, a register 22, a timing generator 23, a memory control circuit 24, and a polarity switching control circuit 25.

The address signals ADw and signals representing the image data Dv in a broad sense (in the following, also these signals are denoted as "Dv") that this display control circuit 200 receives from the external CPU or the like are inputted into the input control circuit 20. Based on the address signals ADw, the input control circuit 20 divides the image data Dv in a broad sense into image data DA and display control data Dc. Then, signals representing the image data DA (in the following, also these signals are denoted as "DA") are supplied to the display memory 21 together with address signals AD based on the address signals ADw, so that the image data DA are written into the display memory 21, and the display control data Dc are written into the register 22. The display control data Dc comprise timing information that specifies the frequency of the clock signal CK and the horizontal scanning period and the vertical scanning period for displaying the image represented by the image data Dv.

Based on the display control data held in the register 22, the timing generator 23 generates the clock signal CK, the horizontal synchronization signal HSY, the vertical synchronization signal VSY, the start pulse signal SP and the latch strobe signal LS. It should be noted that in this embodiment, the driving video signals S1 to Sn that are outputted from the video signal line driving circuit 300 are switched at each horizontal scanning period. In correspondence thereto, also the pulse repeat period of the start pulse signal SP and the latch strobe signal LS supplied to the video signal line driving circuit is one horizontal scanning period. Moreover, the timing generator 23 generates a timing signal for operating the display memory 21 and the memory control circuit 24 in synchronization with the clock signal CK.

The memory control circuit 24 generates address signals ADr for reading out, of the image data DA that are inputted from outside and stored in the display memory 21 via the input control circuit 20, the data representing the image to be displayed on the liquid crystal panel 500. The memory control circuit 24 also generates a signal for controlling the operation of the display memory 21. The address signals ADr and the control signal are given to the display memory 21, and thus, the data representing the image to be displayed on the liquid crystal panel 500 is read out as the digital image signal Da from the display memory 21, and are outputted from the display control circuit 200. As mentioned above, the digital image signal Da is supplied to the video signal line driving circuit 300.

Based on the horizontal synchronization signal HSY and the vertical synchronization signal VSY, the polarity switching control circuit 25 generates the positive and negative voltage application control signals ϕp and ϕn, and the first and second precharge polarity control signals Sca and Scb. Here, the positive voltage application control signal ϕp is at H level in the period in which a voltage with positive polarity is to be outputted from (the output buffer of) the video signal line driving circuit 300, and is at L level at all other times, whereas the negative voltage application control signal ϕn is at H level in the period in which a voltage with negative polarity is to be outputted from (the output buffer of) the video signal line driving circuit 300, and is at L level at all other times.

Moreover, the first and second precharge polarity control signals Sca and Scb are control signals for switching the orientation of a precharge capacitor, which is connected in parallel to the load capacitance within the liquid crystal panel 500 during the OFF period described below. The precharge capacitor is constituted by a first electrode Ep and a second electrode En, arranged in opposition to one another. The first precharge polarity control signal Sca is at H level during the period in which the precharge capacitor is to be connected in parallel to the load capacitance in such an orientation that the first electrode Ep (in the present embodiment this is the electrode with the higher potential) is connected to the video signal line Ls in the liquid crystal panel 500, and is at L level at all other times. Conversely, the second precharge polarity control signal Scb is at H level during the period in which the precharge capacitor is to be connected in parallel to the load capacitance in such an orientation that the second electrode En (in the present embodiment this is the electrode with the lower potential) of the precharge capacitor is connected to the video signal line Ls in the liquid crystal panel 500, and is at L level at all other times.

3 Video Signal Line Driving Circuit

Figure 3:
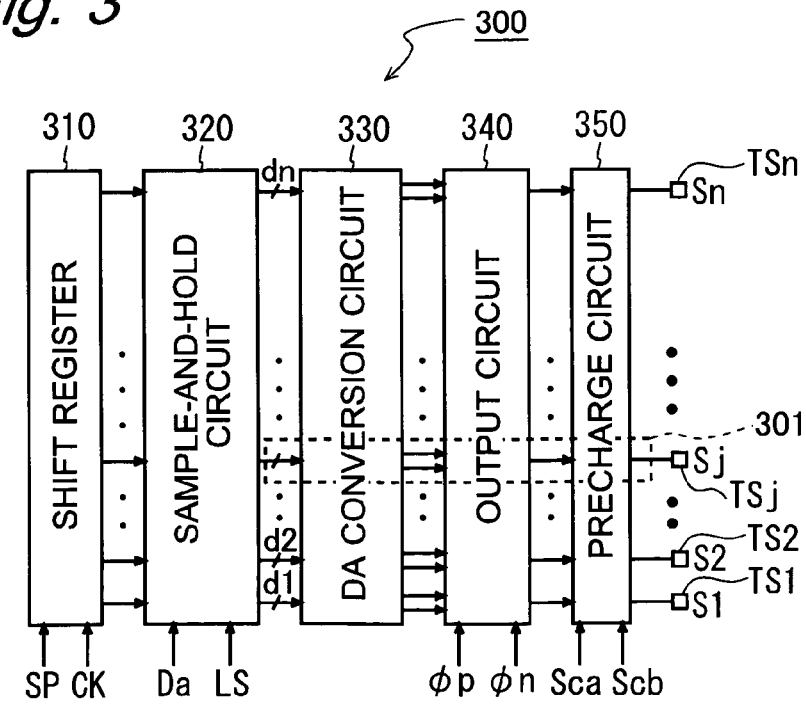
FIG. 3 is a block diagram showing the configuration of a video signal line driving circuit in this embodiment.

FIG. 3 is a block diagram showing the configuration of the video signal line driving circuit 300 in the above-described liquid crystal display device. This video signal line driving circuit 300 includes a shift register 310, a sample-and-hold circuit 320, a DA conversion circuit 330, an output circuit 340, and a precharge circuit 350. The shift register 310 has the same number of stages as there are output terminals TS1, TS2, . . . , TSn, that is, the same number as there are video signal lines Ls in the liquid crystal panel 500. The sample-and-hold circuit 320 outputs digital image signals d1, d2, . . . dn that are 6-bit signals and respectively correspond to the output terminals TS1, TS2, . . . TSn. The DA conversion circuit 330 converts the digital image signals d1, d2, . . . dn into analog signals. Based on these analog signals, the output circuit 340 generates driving video signals S1, S2, . . . , Sn that are to be outputted from the output terminals TS1, TS2, . . . , TSn. The precharge circuit 350 is for reducing the driving capability that is required from this output circuit 340.

In the video signal line driving circuit 300 with this configuration, the start pulse signal SP and the clock signal CK are inputted into the shift register 310, which transfers one pulse included in the start pulse signal SP successively from the input terminal to the output terminal in each horizontal scanning period, based on the signals SP and CK. In correspondence with this transfer, sampling pulses are successively inputted into the sample-and-hold circuit 320. The sample-and-hold circuit 320 samples and holds the digital image signals Da from the display control circuit 200 at the timings of these sampling pulses, latches them with the latch strobe signal LS, and holds them for one horizontal scanning period each. The held digital image signals Da are outputted from the sample-and-hold circuit 320 as 6-bit internal image signals d1, d2, . . . dn. These internal image signals d1, d2, . . . dn are inputted into the DA conversion circuit 330. The DA conversion circuit 330 converts the internal image signals d1, d2, . . . , dn into analog signals of two types, namely of positive polarity and negative polarity. The output circuit 340 performs an impedance conversion, for example with a voltage follower, of these positive and negative polarity analog signals, and generates voltages whose polarity is inverted at predetermined periods as the driving video signals S1, S2, . . . , Sn.

Before the output circuit 340 applies a voltage to each of the video signal lines Ls, the precharge circuit 350 preliminarily charges the load capacitance including the wiring capacitance of the video signal lines Ls and the pixel capacitance in the liquid crystal panel 500 every time the polarity of this applied voltage is inverted, in order to reduce the driving capability that is required from the output circuit 340.

4 Configuration of Main Portions of the Video Signal Line Driving Circuit

FIG. 4 is a circuit diagram showing a portion (corresponding to one output terminal TSj) of the DA conversion circuit 330, the output circuit 340 and the precharge circuit 350 of the video signal line driving circuit 300 shown in FIG. 3, that is, the portion (referred to below as "unit driving circuit") 301 corresponding to one video signal line Ls.

For each output terminal TSj, the DA conversion circuit 330 is provided with a positive polarity DA converter 31*p* converting the digital signal dj, which is the internal image signal corresponding to the output terminal TSj, to a positive voltage Vp, which is an analog voltage of positive polarity, and a negative polarity DA converter 31*n* converting the digital signal dj to a negative voltage Vn, which is an analog voltage of negative polarity.

For each output terminal TSj, the output circuit 340 is provided with a voltage follower serving as a positive polarity output buffer 41*p*, a voltage follower serving as a negative polarity output buffer 41*n*, a positive side switch SWP whose one side is connected to the output terminal of the positive polarity output buffer 41*p*, and a negative side switch SWN whose one side is connected to the output terminal of the negative polarity output buffer 41*n*. The other sides of the positive side switch SWP and the negative side switch SWN are connected to each other. This connection point corresponds to the output terminal of the output circuit 340 and is connected by an output signal line Loj to the output terminal TSj.

The positive side switch SWP, which is controlled by the positive voltage application control signal ϕp shown in FIG. 5A, is turned on when the positive voltage application control signal ϕp is at H level, and is turned off when the positive voltage application control signal ϕp is at L level. The negative side switch SWN, which is controlled by the negative voltage application control signal ϕn shown in FIG. 5B, is turned on when the negative voltage application control signal ϕn is at H level, and is turned off when the negative voltage application control signal ϕn is at L level. With these positive and negative side switches SWP and SWN, a P period, which is the period in which a positive voltage Vp is outputted as the driving video signal Sj from the output terminal TSj, is alternated with an N period, which is the period in which a negative voltage Vn is outputted as the driving video signal Sj from the output terminal TSj, as shown in FIG. 5E. The P period and the N period in this embodiment are substantially equivalent to one horizontal scanning period, but between the P period and the N period, a period in which both the positive side switch SWP and the negative side switch SWN are turned off as shown in FIGS. 5A and 5B (both ϕp and ϕn are at L level) and the output circuit 340 (output buffers 41*p* and 41*n*) of the video signal line driving circuit 300 is electrically separated from the video signal lines Ls within the liquid crystal panel 500 is provided as the OFF period. Thus, the positive side switch SWP and the negative side switch SWN together constitute a switching circuit, or an open/close circuit electrically connecting or disconnecting the output buffers 41*p* and 41*n* to/from the video signal line Ls to realize the P period, the N period and the OFF period.

The precharge circuit 350 is provided with one unit precharge circuit 51 for each output terminal TSj. As shown in FIG. 4, this unit precharge circuit 51 is connected to a suitable position on the output signal line Loj linking the output terminal TSj to the point where the positive side switch SWP is connected to the negative side switch SWN. The unit precharge circuit 51 is made of a precharge capacitor Cpr, a precharge reference voltage supply element, a first switch SWA1, a second switch SWA2, a third switch SWB1, and a fourth switch SWB2. The precharge capacitor CPr is made of a first electrode Ep and a second electrode En, which are arranged in opposition to one another. The precharge reference voltage supply element supplies a precharge reference voltage Vr, which is an intermediate voltage between the positive and the negative voltage to be applied to the video signal lines Ls of the liquid crystal panel 500. One side of the first switch SWA1 is connected to the output signal line Loj, and the other side of the first switch SWA1 is connected to the first electrode Ep of the precharge capacitor Cpr. One side of the second switch SWA2 is connected to the precharge reference voltage supply element, and the other side of the second switch SWA2 is connected to the second electrode En of the precharge capacitor Cpr. One side of the third switch SWB1 is connected to the output signal line Loj, and the other side of the third switch SWB1 is connected to the second electrode En of the precharge capacitor Cpr. One side of the fourth switch SWB2 is connected to the precharge reference voltage supply element, and the other side of the fourth switch SWB2 is connected to the first electrode Ep of the precharge capacitor Cpr. In this unit precharge circuit 51, the switches SWA1, SWA2, SWB1 and SWB2 constitute a connection switching circuit for controlling the parallel switching of the precharge capacitor Cpr with respect to the capacitive load in the liquid crystal panel 500. It should be noted that in this embodiment, the common electrode Ec is used as a precharge reference voltage supply element, and the precharge reference voltage Vr is at the ground level "0". Therefore, in this embodiment, no precharge power source is necessary, but it is also possible to provide a precharge power source as the precharge reference voltage supply element, and to take the voltage of this power source as the precharge reference voltage Vr.

In this unit precharge circuit 51, the first switch SWA1 and the second switch SWA2, which are both controlled by the first precharge polarity control signal Sca shown in FIG. 5C, operate in synchronization, and are turned on when the first precharge polarity control signal Sca is at H level and are turned off when the first precharge polarity control signal Sca is at L level. Moreover, the third switch SWB1 and the fourth switch SWB2, which are both controlled by the second precharge polarity control signal Scb shown in FIG. 5D, operate in synchronization, and are turned on when the second precharge polarity control signal Scb is at H level and are turned off when the second precharge polarity control signal Scb is at L level. Consequently, when the first precharge polarity control signal Sca is at H level and the second precharge polarity control signal Scb is at L level, the first electrode Ep of the precharge capacitor Cpr is connected to the output signal line Loj, and the second electrode En is connected to the common electrode Ec serving as the precharge reference voltage supply element. On the other hand, when the first precharge polarity control signal Sca is at L level and the second precharge polarity control signal Scb is at H level, then the first electrode Ep of the precharge capacitor Cpr is connected to the common electrode Ec serving as the precharge reference voltage supply element, and the second electrode En is connected to the output signal line Loj. Moreover, when both the first and the second precharge polarity control signals Sca and Scb are at L level, then the precharge capacitor Cpr is electrically separated from the output signal line Loj (video signal line Ls).

5 Driving Method

Referring to FIGS. 5A to 5E and 6A to 6D, the following is a description of a method for driving the liquid crystal display device according to this embodiment. It should be noted that the driving of the scanning signal lines Lg of the liquid crystal panel 500 in this embodiment is the same as the driving of typical scanning signal lines in conventional active-matrix liquid crystal panels, so that further explanations thereof have been omitted. The following explanations relate to the driving of video signal lines Ls of the liquid crystal panel 500. Moreover, in the following, the potential of the common electrode Ec is fixed, and as noted above, the common electrode Ec functions as the precharge reference voltage supply element. The precharge reference voltage Vr is "0".

FIGS. 6A to 6D are figures illustrating the operation during the various periods of a unit driving circuit 301 for one video signal line Ls, and schematically show an equivalent circuit (referred to as "unit load circuit" below) 501 representing the capacitive load of the liquid crystal panel 500 corresponding to one video signal line Ls connected to the unit driving circuit 301, as well as the configuration of this unit driving circuit 301. In the FIGS. 6A to 6D, the positive side switch SWP and the negative side switch SWN in the unit driving circuit 301 shown in FIG. 4 are replaced by one equivalent selection switch SW1, and the unit precharge circuit 51 is replaced by an equivalent circuit in which the switch SW2 and the precharge capacitor Cpr are connected in series. Moreover, the unit load circuit 501 models the capacitive load of the liquid crystal panel 500 corresponding to one video signal line Ls, and is made of a load resistance R whose one side is connected to the output signal line Loj of the unit driving circuit 301, and a load capacitance C whose one side is connected to the other side of the load resistance R and whose other side is connected to the common electrode Ec. It should be noted that the capacitance of the precharge capacitor Cpr is set to be sufficiently larger than the value of this load capacitance C.

Figures 6A, 6B, 6C, 6D:
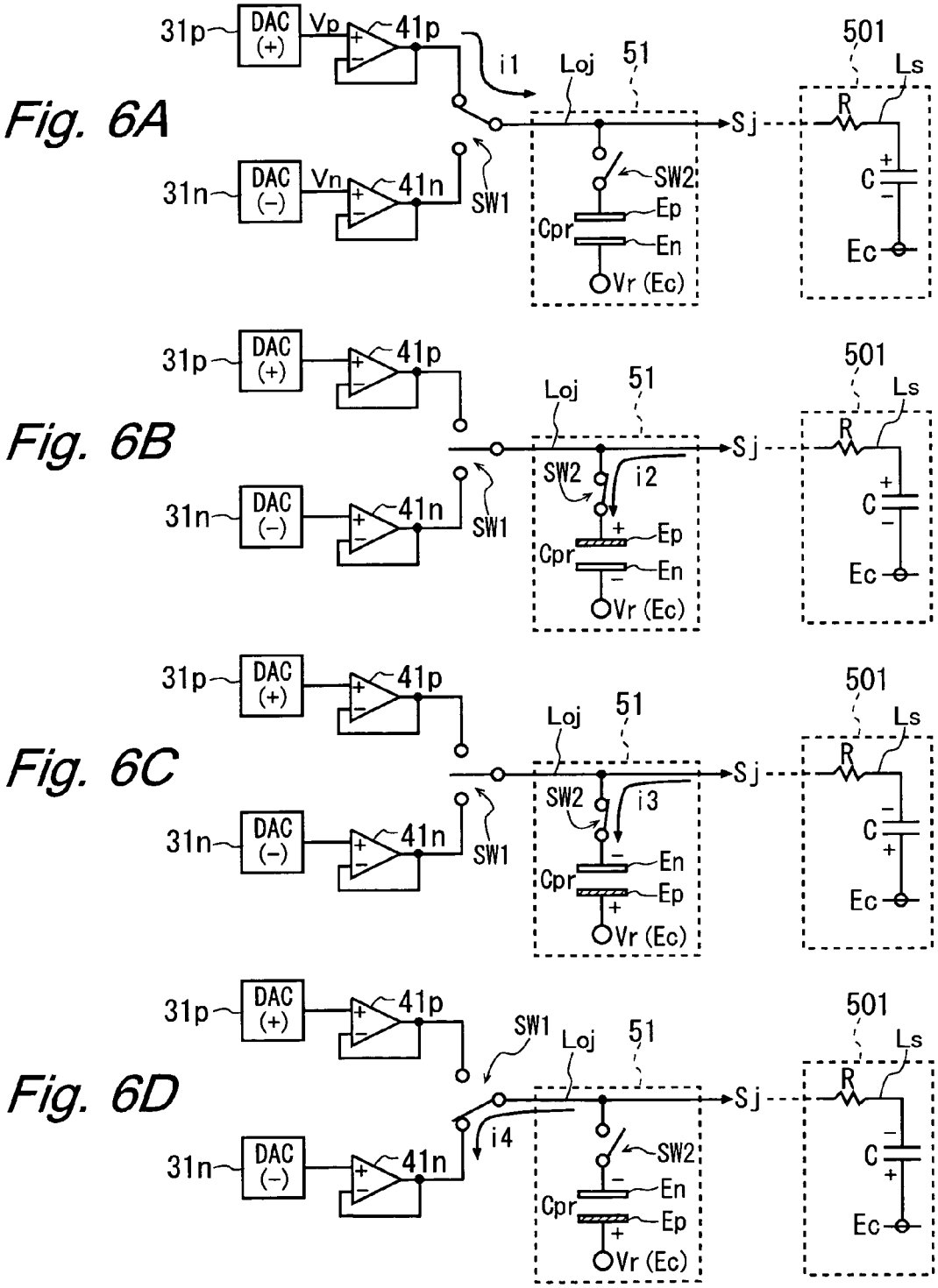
FIGS. 6A to 6D are equivalent circuit diagrams illustrating the operation of the video signal line driving circuit in this embodiment.

In the P period in which the positive voltage application control signal φp is at H level and the negative voltage application control signal φn is at L level (see FIGS. 5A and 5B), the selection switch SW1 connects the positive polarity output buffer 41*p* to the output signal line Loj of the unit driving circuit 301, as shown in FIG. 6A. This output signal line Loj is connected to the video signal line Ls of the liquid crystal panel 500, so that the positive voltage Vp that is outputted from the positive polarity output buffer 41*p* is applied as the driving video signal Sj to the unit load circuit 501, that is, to the capacitive load, and the load capacitance C is charged such that the video signal line Ls assumes a positive potential. In this P period, the switch SW2 in the unit precharge circuit 51 is off, and the precharge capacitance Cpr is electrically separated from the output signal line Loj, so that the precharge capacitor Cpr is neither charged nor discharged.

In the OFF period, in which the positive voltage application control signal φp and the negative voltage application control signal φn are both at L level (see FIGS. 5A and 5B), the output signal line Loj of the unit driving circuit 301 and the video signal line Ls connected thereto are electrically disconnected by the selection switch SW1 from the positive polarity output buffer 41*p* and the negative polarity output buffer 41*n*, as shown in FIGS. 6B and 6C. Moreover, this OFF period includes two periods in which only either one of the first precharge polarity control signal Sca and the second precharge polarity control signal Scb is at H level (the earlier one of these two periods is referred to as the "first precharge period" and the later one of these two periods is referred to as the "second precharge period").

During the OFF period t1-t6 shown in FIG. 5A, in a first precharge period T1pr=t2-t3, in which the first precharge polarity control signal Sca is at H level and the second precharge polarity control signal Scb is at L level, the switch SW2 within the unit precharge circuit 51 is on, the first electrode Ep of the precharge capacitor Cpr is connected to the output signal line Loj, and the second electrode En is connected to the common electrode Ec, as shown in FIG. 6B. Consequently, in the first precharge period T1pr =t2-t3, the charge accumulated in the load capacitor C is moved to the precharge capacitor Cpr, and the potential of the load capacitor as well as the potential of the (first electrode Ep of the) precharge capacitor Cpr take on the same positive potential Vp1 (<Vp) during the period t2-t4 as shown in FIG. 5E.

After this, also in a second precharge period T2pr=t4-t5, in which the first precharge polarity control signal Sca is at L level and the second precharge polarity control signal Scb is at H level, the switch SW2 within the unit precharge circuit 51 is on, and the precharge capacitor Cpr is connected to the output signal line Loj as shown in FIG. 6C, but different from the first precharge period T1pr=t2-t3, the second electrode En is connected to the output signal line Loj, and the first electrode Ep is connected to the common electrode Ec. That is to say, the precharge capacitor Cpr is connected in parallel to the capacitive load (the unit load circuit 501) in opposite orientation than in the first precharge period T1pr=t2-t3. Thus, the load that has accumulated in the load capacitance C is moved to the precharge capacitor Cpr, the load capacitance C is charged in the opposite reaction, and the potential of the load capacitance C and the potential of the (second electrode En of the) precharge capacitor Cr take on the same negative potential Vn1 (with |Vn1|<|Vn|) in the period t4-t6 as shown in FIG. 5E.

In the N period t6-t7, in which the positive voltage application control signal φp is at L level and the negative voltage application control signal φn is at H level (see FIGS. 5A and 5B), the selection switch SW1 connects the negative polarity output buffer 41*n* to the output signal line Loj of the unit driving circuit 301, as shown in FIG. 6D. The output signal line Loj is connected to the video signal line Ls of the liquid crystal panel 500, so that the negative voltage Vn that is outputted from the negative polarity output buffer 41*n* is applied as the driving video voltage Sj to the unit load circuit 501, that is, to the capacitive load, and the capacitive load C is charged such that the video signal line Ls takes on a negative potential. The change of the video signal line Sj (the potential of the output signal line Loj) at this time, that is, the potential change ΔVn that the negative polarity output buffer 41*n* is supposed to change is |Vn−Vn1| (see FIG. 5E), and is by the charge voltage |Vn1| at the precharge capacitor Cpr smaller than that of the conventional method of reducing the power consumption with, for example, the circuit configuration shown in FIG. 15. It should be noted that in the N period, the switch SW2 in the unit precharge circuit 51 is off, and the precharge capacitor Cpr is electrically disconnected from the output signal line Loj, so that the precharge capacitor Cpr is neither charged nor discharged.

After this N period t6-t7 has passed, the device returns to the OFF period t7-t12, but at the first precharge period T1pr=t8-t9 in this OFF period t7-t12, the first precharge polarity control signal Sca is at L level and the second precharge polarity control signal Scb is at H level. Consequently, as shown in FIG. 6C, the precharge capacitor Cpr is connected in parallel to the capacitive load (unit load circuit 501) with such an orientation that the second electrode En having negative potential is connected to the output signal line Loj. That is to say, the precharge capacitor Cpr is connected in parallel to the capacitive load with the same orientation as in the second precharge period T2pr in the OFF period t1-t6 of the previous cycle. Thus, by moving the charge that has been accumulated in the precharge capacitor Cpr that has been already charged with negative polarity to the load capacitance C, the charging with negative polarity is further advanced, and the potential of the load capacitance C and the potential of the (second electrode En of the)

precharge capacitance Cpr take on the same negative potential Vn1' (with |Vn1'|<|Vn|) in the period t8-t10 as shown in FIG. 5E.

After that, also in the second precharge period T2pr=t10-t11, in which the first precharge polarity control signal Sca is at H level and the second precharge polarity control signal Scb is at L level, the switch SW2 within the unit precharge circuit 51 is on, and the precharge capacitor Cpr is connected to the output signal line Loj. However, different to the first precharge period T1pr=t8-t9, the first electrode Ep having positive potential is connected to the output signal line Loj, and the second electrode En is connected to the common electrode Ec, as shown in FIG. 6B. That is to say, the precharge capacitor Cpr is connected in parallel to the capacitive load (unit load circuit 501) with the opposite orientation as in the first precharge period T1pr=t8-t9. Thus, the charge that has accumulated in the precharge capacitor Cpr is moved to the load capacitance C, and after the load capacitance C that has been charged with negative polarity is discharged, it is charged with opposite polarity, and the potential of the load capacitance C and the potential of the (first electrode Ep of the) precharge capacitance Cpr take on the same positive potential Vp1' (with |Vp1'|<|Vp|) in the period t10-t12 as shown in FIG. 5E.

After this (from the time t12 onward), the device advances again to the P period, in which the positive voltage application control signal ϕp is at H level and the negative voltage application control signal ϕn is at L level (see FIGS. 5A and 5B), the selection switch SW1 connects the output signal line Loj of the unit driving circuit 301 to the positive polarity output buffer 41*p*, as shown in FIG. 6A. Since the output signal line Loj is connected to the video signal line Ls of the liquid crystal panel 500, the positive voltage Vp that is outputted from the positive polarity output buffer 41*p* is applied as the driving video signal Sj to the unit load circuit 501, that is, to the capacitive load, and the load capacitance C is charged such that the video signal line Ls assumes a positive potential. The change of the video signal line Sj (i.e. of the potential of the output signal line Loj) at this time, that is, the potential change ΔVp that the positive polarity output buffer 41*p* is supposed to change is Vp−Vp1' (see FIG. 5E), and is by the charge voltage Vp1' at the precharge capacitor Cpr smaller than that of the conventional method of reducing the power consumption with the circuit configuration shown in FIG. 15.

In the above-described embodiment, an OFF period is provided between the P period in which a positive voltage is applied to the video signal line Ls and the N period in which a negative voltage is applied to the video signal line Ls. This OFF period is a period for inverting the polarity of the voltage applied to the video signal line Ls, and includes a first precharge period T1pr and a second precharge period T2pr. In the first precharge period T1pr, the precharge capacitor Cpr is connected in parallel to the unit load circuit 501, which is the capacitive load per video signal line of the liquid crystal panel 500. Thus, the charge is moved between the load capacitance C and the precharge capacitor Cpr, and the load capacitance C and the precharge capacitor Cpr take on a state in which they are charged to the same potential and the same polarity. In the subsequent second precharge period T2pr, the precharge capacitor Cpr is connected in parallel to the capacitive load with an orientation that is opposite from that of the first precharge period T1pr, and thus, the charge is moved between the load capacitance C and the precharge capacitor Cpr, and the load capacitance C and the precharge capacitor Cpr take on a state in which they are charged to the same potential at a polarity that is opposite from that in the first precharge period T1pr. Then, at the P period or the N period after this OFF period, a voltage Vp or Vn of the same polarity as the charge voltage of the load capacitance at this second precharge period T2pr is applied to the capacitive load by the positive polarity buffer 41*p* or the negative polarity buffer 41*n* of the video signal line driving circuit 300 via the video signal line Ls.

As was mentioned above, in the first precharge period T1pr of the OFF period t7-t12 after the negative polarity output buffer 41*n* has applied the negative voltage Vn to the capacitive load (after the N period t6-t7), the precharge capacitor Cpr is connected in parallel to the capacitive load in the same orientation as the orientation of the second precharge period T2pr in the OFF period t1-t6 of the previous cycle (see FIGS. 5C and 5D). Thus, with this embodiment, in the first precharge period T1pr of each OFF period, the precharge capacitor Cpr is connected in parallel to the capacitive load at the same orientation as in the second precharge period T2pr of the OFF period of the previous cycle. Thus, as the polarity inversion of the voltage applied to the capacitive load is repeated, the accumulated charge amount of the precharge capacitor Cpr increases. As a result, the change of the video signal line potential that is to be changed by the output circuit (output buffers 41*p* and 41*n*) becomes gradually smaller. However, as is also shown by the results of the following simulation, the change of the video signal line potential to be changed by the output circuit asymptotically approaches a predetermined value (see FIG. 13). This means, that the accumulated charge of the precharge capacitor Cpr increases and asymptotically approaches the predetermined value, as the polarity inversion of the voltage applied to the capacitive load is repeated.

6 Simulation of the Video Signal Line Driving

As described above, when driving the liquid crystal panel 500 according to the present embodiment, the change ΔVp or ΔVn of the video signal line potential to be changed by the output circuit 340 (the positive polarity or negative polarity output buffers 41*p* and 41*n*) of the video signal line driving circuit 300 is lowered in accordance with the charge voltage portion |Vp1| or |Vn1| (|Vp1'| or |Vn1'|) at the precharge capacitor Cpr, and as a result, the power consumption for driving the video signal line Ls of the liquid crystal panel 500 can be reduced. In order to determine more specifically the reduction effect on the change ΔVp or ΔVn of the video signal line potential to be changed by this video signal line driving circuit 300 as well as the reduction effect on the power consumption, the inventors performed a simulation by numerical calculation of the driving of the video signal lines in two conventional examples and in the present embodiment. Referring to FIGS. 7 to 13, the following is an explanation of this simulation. It should be noted that in the following, the operation of the video signal line driving circuit when driving the capacitive load per video signal line of the liquid crystal panel is simulated, and this capacitive load is expressed by a circuit 502 in which a resistance R2 of 10 Ω and a capacitor corresponding to a load capacitance C2 of 0.5 μF are connected in series (referred to as "CR load circuit" below).

Figure 7:
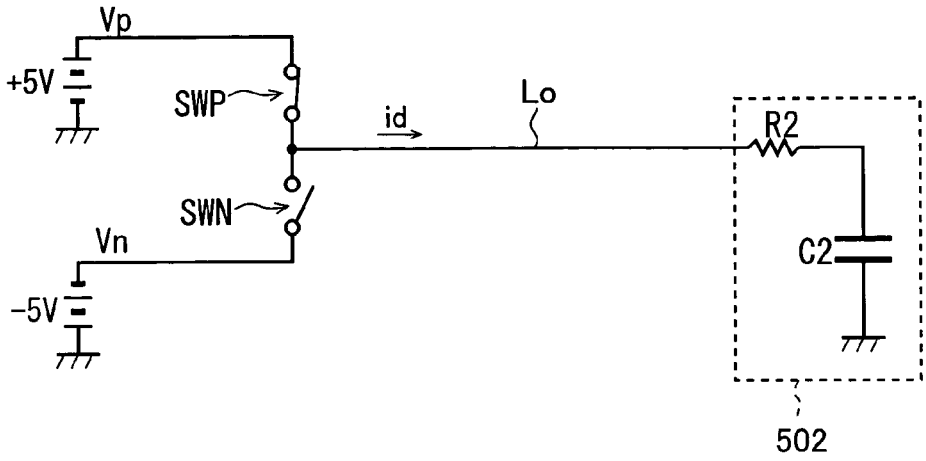
FIG. 7 is a circuit diagram showing a circuit model used for the simulation of the driving of a video signal line in a first conventional example of a liquid crystal display device.

FIG. 7 is a circuit diagram showing a circuit model used for the simulation of the driving of the video signal line in a first conventional example of a liquid crystal display device. In this circuit model, the video signal line driving circuit includes a power source with a positive voltage Vp =+5 V, a power source with a negative voltage Vp=−5 V, a positive side switch SWP whose one side is connected to the power source of the positive voltage Vp, and a negative side switch SNP whose one side is connected to the power source of the negative voltage Vn. The other side of the positive side switch SWP is connected to the other side of the negative side switch SNP, and the point of this connection is connected to via the output signal line Lo to the CR load circuit 502. In this circuit model, when the positive side switch SWP and the negative side switch SWN are reciprocally turned on and off, a voltage with a periodically inverting polarity is applied to the CR load circuit 502.

Figure 10:
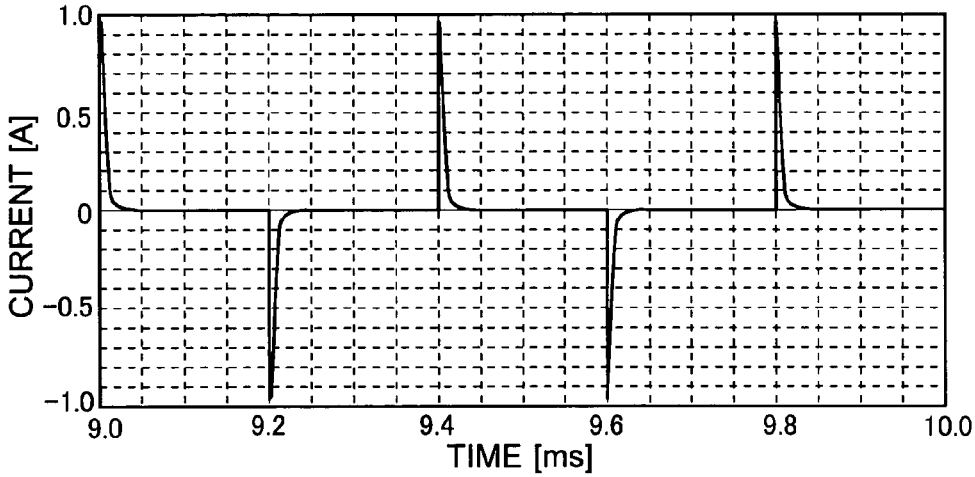
FIG. 10 is a waveform diagram showing the consumption current in a simulation of the driving of a video signal line according to the first conventional example.

FIG. 10 is a diagram of the simulation result for the case that the positive side switch SWP and the negative side switch SWN are reciprocally turned on and off such that the polarity of the voltage applied to the CR load circuit 502 is inverted every 0.2 ms. FIG. 10 shows the current supplied from the (output buffer of the) video signal line driving circuit to the CR load circuit 502 in this case, or in other words, the consumption current id. According to FIG. 10, the peak value of the consumption current id in the first conventional example is about 960 mA.

Figure 8:
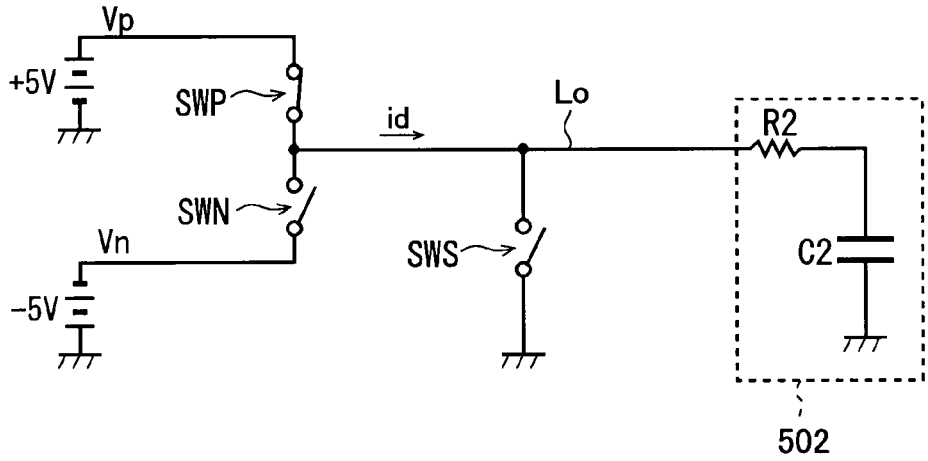
FIG. 8 is a circuit diagram showing a circuit model used for the simulation of the driving of a video signal line in a second conventional example of a liquid crystal display device.

FIG. 8 is a circuit diagram showing a circuit model used for the simulation of the driving of the video signal line in a second conventional example of a liquid crystal display device. In this circuit model, the video signal line driving circuit includes a power source with a positive voltage Vp =+5 V, a power source with a negative voltage Vp=−5 V, a positive side switch SWP and a negative side switch SNP, as in the configuration of the first conventional example, and in addition thereto a switch SWS whose one side is connected to the output signal line Lo connecting the video signal line driving circuit 300 and the load circuit 502, and whose other side is grounded.

Figure 11:
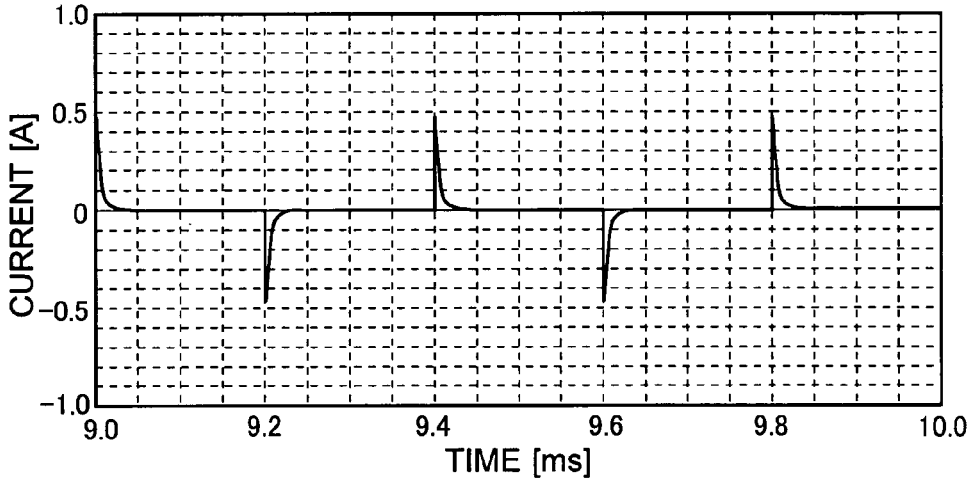
FIG. 11 is a waveform diagram showing the consumption current in a simulation of the driving of a video signal line according to the second conventional example.

FIG. 11 is a diagram of the simulation result for the case that the positive side switch SWP and the negative side switch SWN in this circuit model are substantially reciprocally turned on and off such that the polarity of the voltage applied to the CR load circuit 502 is inverted every 0.2 ms, and shows the consumption current id that is supplied from the signal line driving circuit to the CR load circuit 502 in this case. It should be noted that, as shown in FIGS. 16A and 16B, an OFF period in which both the positive side switch SWP and the negative side switch SWN are off is provided between the periods in which the positive side switch SWP is on and the periods in which the negative side switch SWN is on. The charge accumulated in the load capacitance C2 is discharged by turning the switch SWS on during this OFF period. According to FIG. 11, which shows the simulation results for this circuit model, the peak value of the consumption current id in this second conventional example is about 480 mA.

Figure 9:
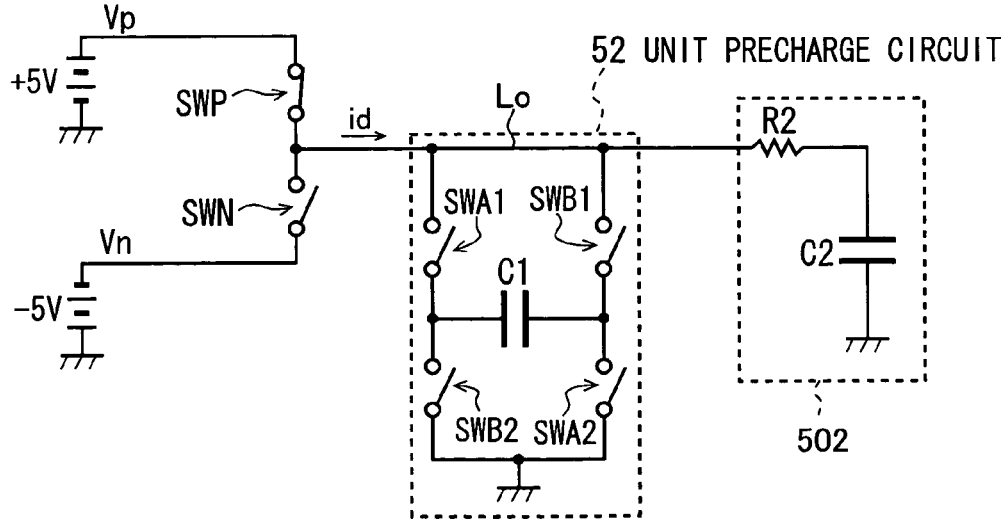
FIG. 9 is a circuit diagram showing a circuit model used for the simulation of the driving of the video signal line according to the above-noted embodiment.

FIG. 9 is a circuit diagram showing a circuit model used for the simulation of the driving of the video signal line according to the present embodiment. In this circuit model, the video signal line driving circuit includes a power source with a positive voltage Vp=+5 V, a power source with a negative voltage Vp=−5 V, a positive side switch SWP and a negative side switch SNP, as in the configuration of the first conventional example, and in addition thereto a unit precharge circuit 52, which is connected to the output signal line Lo connecting the video signal line driving circuit and the CR load circuit 502. This unit precharge circuit 52 corresponds to the unit precharge circuit 51 shown in FIG. 4, and except for the fact that the precharge capacitor is denoted by the reference symbol "C1" and the precharge reference voltage Vr is denoted as the ground potential "0," it is the same as the unit precharge circuit 51 in FIG. 4, so that like structural elements are denoted by like reference symbols, and further explanations are omitted.

In this circuit model, the positive side switch SWP and the negative side switch SWN are substantially reciprocally turned on and off, such that the polarity of the voltage applied to the CR load circuit 502 is inverted substantially every 0.2 ms, but as shown in FIGS. 5A and 5B, an OFF period in which both the positive side switch SWP and the negative side switch SWN are off is provided between the period in which the positive side switch SWP is on (P period in which ϕp is at H level) and the period in which the negative side switch SWN is on (N period in which ϕn is at H level). Moreover, the first switch SWA1 and the second switch SWA2 in the unit precharge circuit 52 operate in synchronization, and are both controlled by the first precharge polarity control signal Sca shown in FIG. 5C. Also the third switch SWB1 and the fourth switch SWB2 in the unit precharge circuit 52 operate in synchronization, and are controlled by the second precharge polarity control signal Scb shown in FIG. 5D. With this circuit model, the driving of the video signal lines in the present embodiment already explained with reference to FIGS. 5A to 5E and 6A to 6D was simulated. It should be noted that with this simulation, the capacitance of the precharge capacitor C1 was set to 10 μF, but this value is merely an example, and generally, a value that is suitable with regard to the effects of the present invention, such as lowering the power consumption of the video signal line driving circuit 300, is chosen in consideration of the load capacitance C2.

Figure 12:
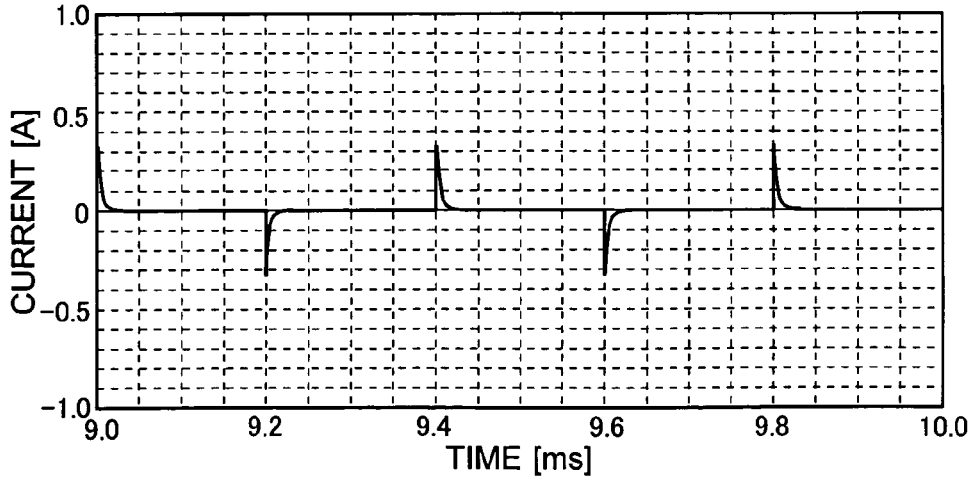
FIG. 12 is a waveform diagram showing the consumption current in a simulation of the driving of a video signal line according to the above-noted embodiment.
Figure 13:
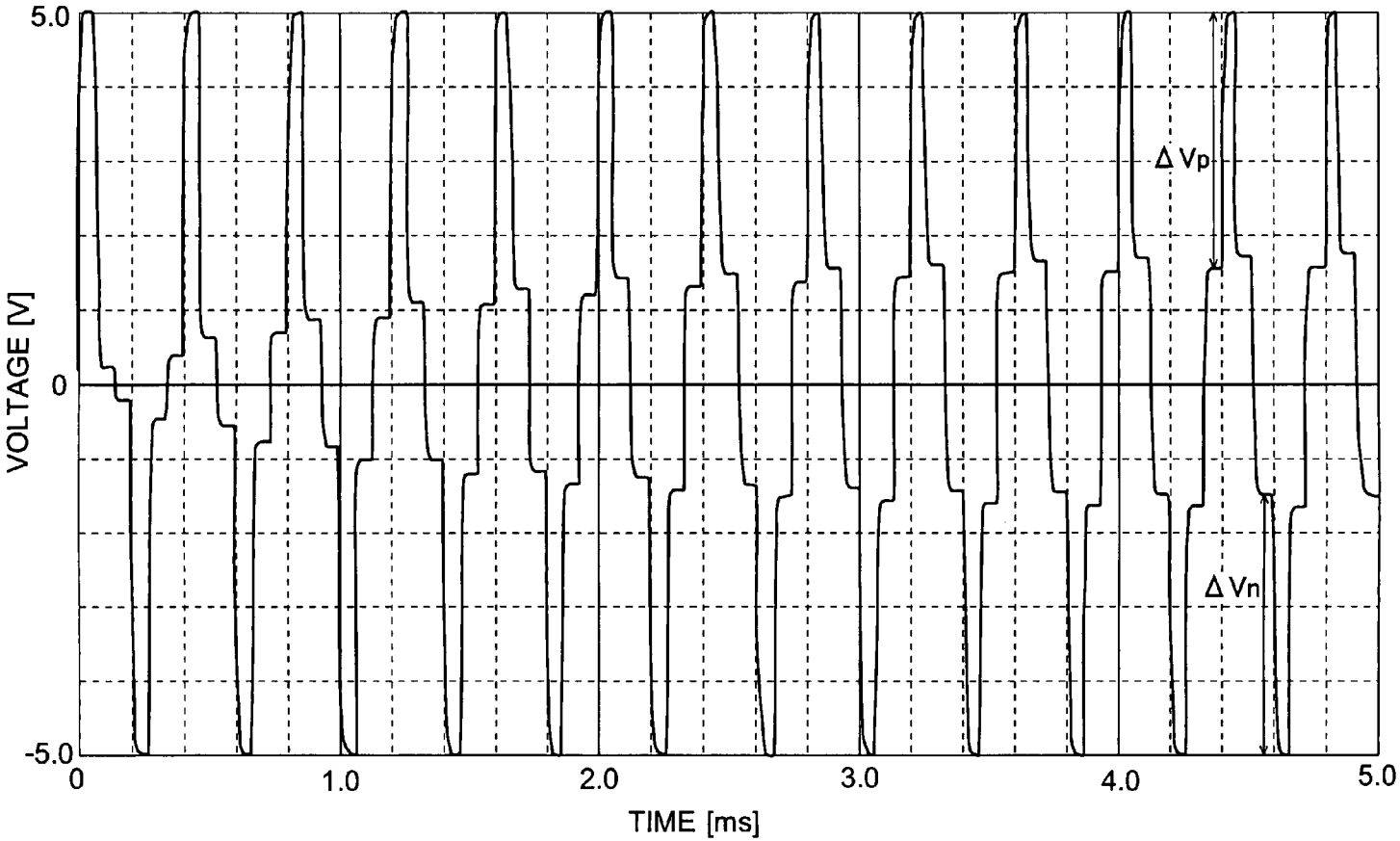
FIG. 13 is a waveform diagram showing the voltage applied to the capacitive load in a simulation of the driving of a video signal line according to the above-noted embodiment.
Figure 17A:
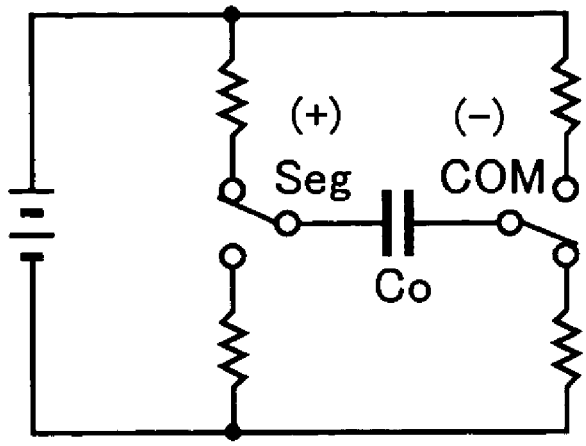
PRIOR ART Fig. 17A
FIGS. 17A ad 17B are circuit diagrams illustrating a second conventional method for reducing the power consumption in a liquid crystal display device.
Figure 17B:
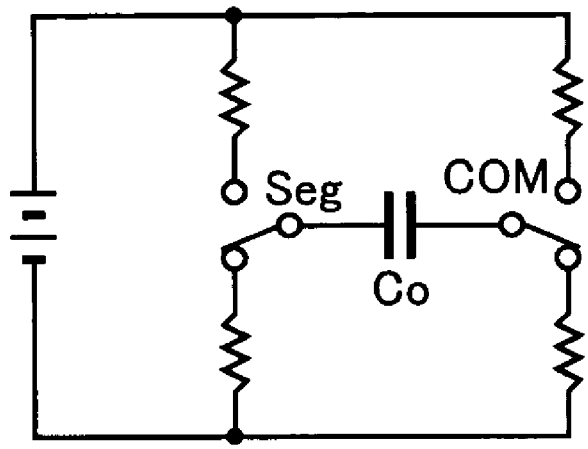
PRIOR ART Fig. 17B

FIGS. 12 and 13 are diagrams showing the results of the simulation for driving the video signal lines in the present embodiment. FIG. 12 shows the current supplied from the power source with the positive voltage Vp or the power source with the negative voltage Vn corresponding to the output buffer of the video signal line driving circuit to the CR load circuit 502, or in other words, the consumption current id. FIG. 13 shows the voltage applied to the load capacitance C2 (referred to as "load capacitance voltage" in the following). The voltage changes shown in FIG. 13 correspond to the potential changes of the video signal line Ls, and as can be seen by comparison with FIG. 5E, ΔVp shown in FIG. 13 is the change of the load capacitance voltage due to the current supplied from the power source with the voltage Vp=+5V to the CR load circuit 502, whereas ΔVn shown in FIG. 13 is the change of the load capacitance voltage due to the current (negative current) supplied from the power source with the voltage Vn=−5V to the CR load circuit 502. In the simulation, these voltage changes ΔVp and ΔVn decrease over time after the operation of the circuit in FIG. 9 starts, and asymptotically approach a predetermined value. For example, after 5 ms, the voltage changes ΔVp and ΔVn become about a third of the potential change |Vp−Vn|=10 V at the polarity inversion of the voltage applied to the CR load circuit 502. Accordingly, also the consumption current id is reduced, and the peak of the consumption current id becomes about 330 mA, as shown in FIG. 12.

Now, the power consumption P per single output of the video signal line driving circuit can be expressed in a simple model by the following relation:

$$P \sim f \cdot c \cdot V^2$$

Here, f denotes the frequency, c denotes the load capacitance driven by the video signal line driving circuit, and V denotes the driving voltage. Consequently, as a result of the simulation shown in FIGS. 10 to 13, it can be seen that with the present embodiment, the power consumption of the video signal line driving circuit 300 can be reduced significantly compared to the conventional art (first conventional example and second conventional example).

7 Advantageous Effects

As described above, in the present embodiment, OFF periods in which the output buffers (output circuit 340) in the video signal line driving circuit 300 are electrically disconnected from the video signal lines Ls are provided between the P periods in which a positive voltage is to be applied and the N periods in which negative voltage is to be applied to the liquid crystal panel 500 serving as the capacitive load, and a precharge capacitor Cpr is connected to each of the output signal lines Loj in a first precharge period T1pr and a second precharge period T2pr within these OFF periods (see FIGS. 4, 5C and 5D). Moreover, by connecting a precharge capacitor Cpr in parallel to the capacitive load for each of the video signal lines Ls of the liquid crystal panel 500 in the first precharge period T1pr, the load capacitance C and the precharge capacitor Cpr assume a state in which they are charged to the same potential and the same polarity, and by connecting the precharge capacitor Cpr in the following second precharge period T2pr in parallel to the capacitive load at an orientation that is opposite to the orientation in the first precharge period T1pr, the load capacitance C and the precharge capacitor Cpr take on a state in which they are charged to the same potential and a polarity that is opposite to the polarity in the first precharge period T1pr (see FIGS. 6B and 6C). That is to say, since the capacitance of the precharge capacitor Cpr is larger than the load capacitance C, the polarity of the voltage applied to the load capacitance C in the second precharge period T2pr is inverted. Due to this operation of the precharge circuit 350 (the unit precharge circuit 51) in the OFF period, the changes ΔVp and ΔVn in the video signal line potential that are to be changed by the positive polarity and negative polarity output buffers 41*p* and 41*n* of the video signal line driving circuit 300 are reduced in accordance with the charge voltage at the precharge capacitor, and become less than half the change amount |Vp−Vn| of the video signal line potential at the time of polarity inversion (FIG. 5E). As a result, the power consumption of the video signal line driving circuit 300 can be reduced more than in the conventional art. And according to the above-described simulation results, the potential changes ΔVp and ΔVn of the video signal lines Ls that are to be changed by the output circuit (output buffers) of the video signal line driving circuit 300 can be reduced to about ⅓ of the changes in the video signal line potential at the time of the polarity inversion of the voltage applied to the capacitive load of the liquid crystal panel 500 (see FIG. 13). This means, that a considerable reduction of the power consumption in the video signal line driving circuit 300 is possible.

Moreover, with the present embodiment as described above, different from conventional configurations using a precharge power source (see FIGS. 15 and 16A to 16D or JP H07-134573A and the corresponding U.S. Pat. No. 5,929,847), the precharge capacitor Cpr is charged in accordance with the charge voltage (corresponding to the pixel value) of the load capacitance C in the liquid crystal panel 500. Next, the polarity of the corresponding charge voltage at the precharge capacitor Cpr is inverted, and the load capacitance C is precharged with the charge voltage after the inversion. Consequently, with this embodiment, the precharge voltage, which is the voltage applied by the precharge capacitor Cpr to the video signal line Ls in the second precharge period, is automatically adjusted in accordance with the display content (pixel value). Therefore, different from the conventional technology, in which the precharge voltage is fixed, a situation in which the precharge voltage takes on a value that is unsuitable for the display content is avoided. Moreover, in this embodiment, a precharge power source is not necessary, so that there is also the advantage over the conventional configuration shown in FIGS. 15 and 16A to 16D that there is no power consumption due to the precharge power source.

8 Modification Examples

In the above-described embodiment, a unit precharge circuit 51 is provided for each output terminal TSj (j=1, 2, . . . , n) within the video signal line driving circuit 300. But instead, it is also possible to provide a unit precharge circuit 51 for each video signal line Ls in the liquid crystal panel 500.

Moreover, in the above-described embodiment, the common electrode Ec of the liquid crystal panel 500 is at a fixed potential (ground level), but instead, the common electrode Ec may also be configured to be AC driven as shown in FIG. 14B. Also with this configuration, due to the operation of the precharge circuit 350 (unit precharge circuit 51) the changes ΔVp and ΔVn of the video signal line potential to be changed by the positive polarity output buffer 41*p* and the negative polarity output buffer 41*n* of the video signal line driving circuit 300 become smaller in accordance with the charge voltage at the precharge capacitor Cpr, and the same effects as in the above-described embodiment, such as a reduction of the power consumption of the video signal line driving circuit 300, can be attained.

Furthermore, the above-described embodiment relates to a liquid crystal display device and a circuit for driving the same, but the present invention is not limited to this, and the present invention can be equally applied to driving circuits of other display devices or devices other than display devices, provided they are driving circuits driving a capacitive load by applying to that capacitive load a voltage corresponding to an input signal while periodically inverting the polarity of this voltage. Moreover, also in this case, the amplitude of the driving voltage of this driving circuit is substantially reduced in accordance with the charge voltage at the precharge capacitor, so that the same effects as in the above-described embodiment, such as a reduction in the power consumption of the driving circuit, can be attained.

While the invention has been described in detail, the foregoing description is in all aspects illustrative and not restrictive. It is understood that numerous other modifications and variations can be devised without departing from the scope of the invention.

What is claimed is:

1. A driving circuit for driving a capacitive load by applying to the capacitive load a voltage that corresponds to an input signal and whose polarity is periodically inverted, the driving circuit comprising:

an output circuit for outputting the voltage corresponding to the input signal and applying the voltage corresponding to the input signal to the capacitive load;

an open/close circuit for electrically disconnecting the output circuit from the capacitive load for a predetermined time interval in which the polarity of the voltage applied to the capacitive load is inverted;

a capacitor having a predetermined capacitance; and a connection switching circuit for connecting the capacitor for a first predetermined period within an OFF period, which is the predetermined time interval during which the output circuit is electrically disconnected from the capacitive load, in parallel to the capacitive load, and connecting the capacitor for a second predetermined period after the first predetermined period within the OFF period in parallel to the capacitive load with an orientation that is opposite to the orientation in the first predetermined period.

2. The driving circuit according to claim 1, wherein the connection switching circuit connects the capacitor in parallel to the capacitive load with the same orientation for the first predetermined period in a second OFF period following a first OFF period as an orientation of the second predetermined period in the first OFF period, the first and second OFF periods each being the predetermined time interval during which the output circuit is electrically disconnected from the capacitive load.

3. The driving circuit according to claim 2, wherein the capacitor has a capacitance that is larger than the capacitance of the capacitive load such that the polarity of the voltage applied to the load capacitance is inverted in the second predetermined period within each OFF period.

4. The driving circuit according to claim 1, wherein the connection switching circuit comprises:

a first and a second switch that are turned on during one of the first and second predetermined periods and are turned off during the other of the first and second predetermined periods;

a third and a fourth switch that are turned off during the one of the first and second predetermined periods and are turned on during the other of the first and second predetermined periods;

wherein one side of the capacitor is connected via the first switch to one side of the capacitive load and is connected via the fourth switch to a predetermined precharge reference voltage; and wherein the other side of the capacitor is connected via the third switch to the one side of the capacitive load and is connected via the second switch to the predetermined precharge reference voltage.

5. A display device for displaying an image represented by an input signal by applying to a capacitive load a voltage that corresponds to the input signal and whose polarity is periodically inverted, the display device comprising:

an output circuit for outputting the voltage corresponding to the input signal and applying the voltage corresponding to the input signal to the capacitive load;

an open/close circuit for electrically disconnecting the output circuit from the capacitive load for a predetermined time interval in which the polarity of the voltage applied to the capacitive load is inverted;

a capacitor having a predetermined capacitance; and a connection switching circuit for connecting the capacitor for a first predetermined period within an OFF period, which is the predetermined time interval during which the output circuit is electrically disconnected from the capacitive load, in parallel to the capacitive load, and connecting the capacitor for a second predetermined period after the first predetermined period within the OFF period in parallel to the capacitive load with an orientation that is opposite to the orientation in the first predetermined period.

6. The display device according to claim 5, further comprising;

a plurality of video signal lines;

a plurality of scanning signal lines intersecting with the plurality of video signal lines;

a scanning signal line driving circuit for generating a plurality of scanning signals for selectively driving the plurality of scanning signal lines and applying the plurality of scanning signals respectively to the plurality of scanning signal lines; and a plurality of pixel formation portions arranged in a matrix in correspondence with intersections of the video signal lines and the scanning signal lines;

wherein each pixel formation portion comprises:

a switching element that is turned on and off by the scanning signal applied by the scanning signal line driving circuit to the scanning signal line passing through the corresponding intersection;

a pixel electrode that is connected via the switching element to the video signal line passing through the corresponding intersection; and a common electrode that is shared by the plurality of pixel formation portions and that is arranged such that a predetermined capacitance is formed between the common electrode and the pixel electrode;

wherein the capacitive load is formed by the video signal lines, the pixel electrodes and the common electrode; and wherein the output circuit applies a voltage corresponding to the input signal to each of the video signal lines; and wherein the capacitor and the connection switching circuit are provided for each of the video signal lines.

7. The display device according to claim 5, wherein the connection switching circuit connects the capacitor in parallel to the capacitive load with the same orientation for the first predetermined period of a second OFF period following a first OFF period as an orientation of the second predetermined period in the first OFF period, the first and second OFF periods each being the predetermined time interval during which the output circuit is electrically disconnected from the capacitive load.

8. The display device according to claim 7, wherein the capacitor has a capacitance that is larger than the capacitance of the capacitive load such that the polarity of the voltage applied to the load capacitance is inverted in the second predetermined period within each OFF period.

9. The display device according to claim 5, wherein the connection switching circuit comprises:

a first and a second switch that are turned on during one of the first and second predetermined periods and are turned off during the other of the first and second predetermined periods;

a third and a fourth switch that are turned off during the one of the first and second predetermined periods and are turned on during the other of the first and second predetermined periods;

wherein one side of the capacitor is connected via the first switch to one side of the capacitive load and is connected via the fourth switch to a predetermined precharge reference voltage; and wherein the other side of the capacitor is connected via the third switch to the one side of the capacitive load and is connected via the second switch to the predetermined precharge reference voltage.

10. A driving method for driving a capacitive load by applying with an output circuit to the capacitive load a voltage that corresponds to an input signal and whose polarity is periodically inverted, the driving method comprising:

a voltage application step of applying to the capacitive load a voltage corresponding to the input signal;

a disconnection step of electrically disconnecting the output circuit from the capacitive load for a predetermined time interval in which the polarity of the voltage applied to the capacitive load is inverted;

a first connection step of connecting a capacitor having a predetermined capacitance for a first predetermined period within an OFF period, which is the predetermined time interval during which the output circuit is electrically disconnected from the capacitive load, in parallel to the capacitive load; and a second connection step of connecting the capacitor for a second predetermined period after the first predetermined period within the OFF period in parallel to the capacitive load with an orientation that is opposite to the orientation in the first predetermined period.

11. The driving method according to claim 10, wherein the capacitor is connected in parallel to the capacitive load with the same orientation for the first predetermined period in a second OFF period following a first OFF period as an orientation of the second predetermined period in the first OFF period, the first and second OFF periods each being the predetermined time interval during which the output circuit is electrically disconnected from the capacitive load.

12. The driving method according to claim 11, wherein the capacitor has a capacitance that is larger than the capacitance of the capacitive load such that the polarity of the voltage applied to the load capacitance is inverted in the second predetermined period within each OFF period.

* * * * *